United States Patent [19]

Lucas

[11] 4,329,088

[45] May 11, 1982

[54] TILT-UP/JACK-UP OFF-SHORE DRILLING APPARATUS AND METHOD

[75] Inventor: Joseph E. Lucas, Houston, Tex.

[73] Assignee: Marine Engineering Company, C.A., Caracas, Venezuela

[21] Appl. No.: 62,537

[22] Filed: Jul. 31, 1979

Related U.S. Application Data

[62] Division of Ser. No. 899,391, Apr. 24, 1978.

[51] Int. Cl.[3] ..... E02B 17/04

[52] U.S. Cl. ..... 405/196; 114/264; 114/293; 254/105; 405/203; 405/205; 405/199

[58] Field of Search ..... 405/195–208; 114/258, 264, 265, 293; 254/95–112

[56] References Cited

U.S. PATENT DOCUMENTS

| | | | |
|---|---|---|---|
| 2,699,321 | 1/1955 | Nelson | 405/227 X |
| 2,932,486 | 4/1960 | Suderow | 405/199 X |
| 2,944,403 | 7/1960 | Smith | 405/199 |
| 2,987,892 | 6/1961 | Reeve | 405/227 X |
| 3,031,997 | 5/1962 | Nesbitt | 114/293 |
| 3,032,105 | 5/1962 | Reistle | 114/264 X |
| 3,857,247 | 12/1974 | Phares | 405/227 |
| 3,876,181 | 4/1975 | Lucas | 405/198 X |
| 3,975,841 | 8/1976 | Steenken et al. | 114/258 X |
| 4,041,711 | 8/1977 | Lucas | 405/199 X |

*Primary Examiner*—Dennis L. Taylor

*Attorney, Agent, or Firm*—Harry W. F. Glemser

[57] ABSTRACT

Method and apparatus for elevating a prefabricated, offshore, well-drilling or other platform on a prefabricated upright support in deep water. The platform is elevated by jacking units on a platform having legs suspended from a superstructure on the support. The upright support is stabilized against wind and wave action by four guy lines anchored at one end to the sea bottom and connected at its opposite end to the drum of winches mounted on two of the caissons. There are two drums in each of the two caissons. Each drum is connected to one guy line and is separately driven by a remotely controlled, reversible hydraulic motor. The motors are operated to maintain the support vertical and the fottings equally loaded; otherwise, uneven penetration of the footings into the sea bed would result. The guy lines are always tensioned against marine and wind forces.

The platform is buoyant and has four open caisson wells arranged in the same geometric pattern as the caissons of the support. The platform is towed to the drilling site and positioned in alignment with the support. Berthing of the platform relative to the support is accomplished by four lines anchored at one end to the sea bottom; two fore and two aft, and connected to winches mounted fore and aft on the platform; and by four cables, one cable being connected with each caisson and to a winch mounted on the platform. The winch connected to the cables are operable to berth the platform in the support.

6 Claims, 43 Drawing Figures

370
370B 370
370A 12
40C
38C
44
46
50
134
146
156
310
348
350

146
134
40
156
44
310
344
346
342
42
46
50
232
202
298
192
212
198
190
296
200
262
188
198A
118
204
206
208
82
184
364
315
328
318
316
332
334
330
314
312
8
324
322
326
336
196A
182
186
338
320
4
34
36
38
306
340
194
194A
196
236

140
146
142
142
144
150
138
134
158
136
56
152
156
136
46
60
44
154
48
48
68
64
70
66
76
40
62
58
78
50

146
30

142
148
148
134
144
138
140
150
158
152
156
72
154
56
60
74
66
356
48
360
48
68
64
70
76
62
58
40
78
30
50

134

136
52
56
72
46
60
40
44
66
48
68
64
48
70
62
76
38
8
34
78
54
58

32
33
36
50
82
118
162
164
166
168
170
171
172
174
175
176
177
178
180
182
186
188
190
192
194
194A
196
196A
198
198A
202
204
206
208
212
214
214A
216
218
218A
220
222
223
226
228
229
230
231
232
234
236
238
240
242
244
246
248
250
252
254
256
258
260
262
263
264
265
266
268
270
272
274
276
277
278
280
282
283
284
286
288
290
292
294
295
296
298

TILT-UP/JACK-UP OFF-SHORE DRILLING APPARATUS AND METHOD

CROSS REFERENCE

This application is a division of my co-pending application Ser. No. 899,391, filed Apr. 24, 1978.

BACKGROUND OF THE INVENTION

1. Field of the Invention

This invention relates to off-shore well-drilling and related equipment and, more particularly, to a prefabricated drilling and production platform; a prefabricated support for the platform; and jacking means for elevating the platform on the support.

2. Description of the Prior Art

Prefabricated drilling and production platforms and supports therefor, and jacking mechanisms for raising the platforms on the supports have been devised heretofore, but many of these are suitable only for use in shallow and relatively calm waters. Some of such prior platforms have utilized jacking mechanisms including racks and pinions with the racks attached to square spuds, but these have the disadvantage that the spuds must be pre-mounted in openings in the platform and the racks indexed with pinions mounted on the barge, so that proper engagement can be effected. Such structure is shown in Bulkley et al. U.S. Pat. No. 2,589,146. Racks and pinions when applied to caissons have the further disadvantage that pressure loads are applied to local areas of the caissons, which may cause damage or collapse, or require excessive and undesirable internal bracing of the caissons. Internal bracing is particularly objectionable when conductor pipes are to be located in the caissons.

Other prior jacking devices include annular rubber tube-like elements carried by the barge or platform and surrounding the caissons. A jack of this type is disclosed in Suderow U.S. Pat. No. 2,948,119. The rubber elements must be inflated by air to grip the caissons, and manipulated to elevate the barge on the caissons. Such devices are objectionable because the rubber elements are subject to rapid wear, blow out, require substantial maintenance and frequent replacement. Furthermore, they have a tendency to slip relative to the caissons, particularly if the exterior surface of the caissons is contaminated by oil, algae, or mud. Such devices are also subject to failure and allowing the barge to drop back onto the water whenever the air supply fails, as by the rupture of an air hose.

Still another jacking device, known as a cable jack includes criss-crossed cables that are operable for positively gripping the exterior of the caissons and raising the platform on the caissons. Such jack is disclosed in my prior U.S. Pat. No. 2,858,105. The cable jacks are much more satisfactory than the rack and pinion type jack, and the inflatable rubber tube device. However, all of the foregoing types of jacking devices take considerable time to "set up" and to be operated to effect elevation of the platform to the desired working height. Such jacking devices are unsuitable for use in rough waters because of the potential damage to either the caissons or the platform, or both, during the period that the platform is subject to movement by wave action. The hazards, of course, are less after the platform has been raised above wave level effect.

A so-called "pin" type jacking system is disclosed in Suderow U.S. Pat. No. 2,932,486. In such system channel members with spaced openings are welded to opposite sides of the caissons, and jacking mechanisms including hydraulically operated pins receivable in said openings are intended to raise a barge relative to the caissons. However, such system presents the problem of aligning the pins with the openings, as well as the possibility of the pins becoming bent and jamming so that retraction is impaired, if not rendered impossible.

A prefabricated platform support structure that is towed to the drilling site and sunk, is now new per se. A structure of this type is disclosed in the patent to Kuss et al., U.S. Pat. No. 2,586,966. However, the patentees contemplate building a platform on the caissons after the support has been anchored to the sea bed. Such procedure is objectionable because it is expensive, slow, impractical, and very hazardous. Considerable auxiliary equipment is required in the way of tugs and lighters to bring the platform components to the site, and derrick barges are required for use in erecting the components on the caissons. Obviously, no erection work can be done in rough seas, at which time all personnel and rented equipment remain idle at tremendous costs.

A prefabricated platform with three caisson wells has heretofore been used with a prefabricated tripod support in constructing a structure known as Texas Tower No. 4. Jacking devices somewhat similar to the type of cable jack disclosed in Nixon U.S. Pat. No. 2,833,188 were employed, but a great deal of time was wasted in threading the cables through the gripping devices before the hoisting operation could be started, and during which "set up" time the platform and caissons were in constant danger of being seriously damaged by wind and wave action. The danger continued during the jacking operation, which was very slow, and until the platform was raised high enough to clear the waves.

The foregoing objections and disadvantages are overcome by the apparatus and methods for quickly erecting off-shore platforms disclosed in my prior U.S. Pat. Nos. 3,876,181 and 4,041,711, over which the present invention constitutes an improvement, particularly with respect to a more stable platform support, and a simplified jacking system, which results in great savings in "set up" time, jacking time and in the tonnage of steel required in fabrication. These factors assure substantial savings in labor and material costs, both of which are important considerations in all off-shore drilling ventures. Moreover, since the present platform and support are prefabricated and equipped prior to installation, the need for derrick barges and other construction equipment is eliminated, together with their extremely high rental costs. Also of prime importance is the safety factor, which is provided by the "fail safe," yet economical, jacking units of the present invention, which automatically prevent dropping of the platform during the jacking up operation.

SUMMARY OF THE INVENTION

The present invention is particularly adapted for use in deep water and under conditions of severe wind and wave action, such as is encountered in the deep waters of the North Sea area and in certain waters beyond the geographical continental shelves.

The present invention overcomes the difficulties found in certain prior platform elevating or jacking devices in that it makes it possible to reduce to a minimum the jacking time required to elevate a platform to working height on a support structure, particularly in rough seas when time is a very critical factor.

The present support is prefabricated in the form of a rectangular quadruped with the legs consisting of two large diameter caissons and two relatively smaller diameter caissons, which latter are closer together at their upper ends than the large diameter caissons, but wherein the lower ends of all of the caissons are of the same diameter and spaced the same distance apart. Conductor pipes for subsequent use in drilling operations are preferably installed in the large caissons at the shipyard, since this will save time later in starting drilling operations.

The lower portions of the caissons are interconnected by X-bracing and their upper portions extend beyond the bracing to receive the platform. The caissons are further braced at their extended upper ends by temporary struts, which are also used by riggers to get from the top of one caisson to the top of another. The caissons are additionally braced by diagonally disposed tensioned cables interconnecting their upper ends. The support is buoyant and is towed to the drilling site in a horizontal position. The caissons are watertight and are provided with flood control valves so that the support can be floated out to the drilling site and there tilted into an upright position by admitting sea water into the caissons. Controlled flooding of the caissons is continued until the caisson footings are about 25 feet above sea bottom. The support is then manoeuvered by tugs to position it over the exact area and azimuth desired, whereupon it is further flooded to sink it to the sea bottom. Each footing consists of a large can containing piles, which piles are later driven to firmly anchor the support to the sea bottom. The footings are jetted down with high pressure water jets in combination with known air lifts. The support is stabilized against wind and wave action by means including four anchored guy lines connected to dual drum winches mounted in two of the caissons. Each drum is connected to one guy line to control the slack therein and is driven by a remotely controlled, reversible hydraulic motor.

The drilling and production platform is also completely prefabricated in a shipyard and is fully equipped with all components necessary for drilling and oil production, including cargo and pipe handling cranes, power plants, utilities, pumps, crew's quarters, a heliport, the present jacking equipment, etc. All machinery and jacking equipment are tested at the shipyard, so far as the testing of equipment can be effected at such facility. This can also save a lot of time, if any equipment is found to have a malfunction.

The platform is buoyant and has four open caisson wells arranged in the same geometric pattern as the caissons of the support. The platform is towed to the drilling site and positioned in alignment with the support. Berthing of the platform relative to the support is accomplished by four lines anchored at one end to the sea bed, two fore and two aft, and connected to winches mounted fore and aft on the platform; and by four large "Nylon" cables, one cable being connected with each caisson and to a winch mounted on the platform. The "Nylon" cables provide the "yield" necessary to accommodate the motion of the platform relative to the support during berthing, without snapping the cables. Operation of the winches on the platform connected to the "Nylon" cables pulls the platform into berthing position between the caissons of the support; whereas, operation of the fore and aft winches connected to the platform anchor lines is principally to stabilize and maintain the platform in proper alignment with the support during berthing. However, the fore winches may be used to pull the platform forwardly. After berthing, locking gates on the platform are closed to hold the platform in place preparatory to the jacking operation.

The design of the jacking equipment is such that low maintenance drilling and production platforms can be installed in rough water with substantial savings of time and money over prior conventional structures, without requiring the use of additional auxiliary equipment, such as derrick barges, etc., which cause most of the weather delays in erecting a drilling platform.

At least one pair of preassembled jacking units is mounted upon the platform at each caisson well. A superstructure is premounted on the upper end of each caisson. A set of self-energizing "fail safe" wedge slips is mounted in the superstructure near each of its ends. Each jacking unit includes a tubular jacking leg. Means are provided for positioning each jacking leg so as to positively lock its upper end in the slips in the superstructure after berthing. Each jacking unit also includes a jacking mechanism comprising two slip holders, each containing a set of self-energizing, "fail safe" wedge slips surrounding the jacking leg. Lifting rods associated with slip holder housings are pivotally connected at their lower end to the platform. Such arrangement greatly reduces the jacking "set up" time, which not only reduces costs but is extremely important, particularly in rough seas, in effecting elevation of the platform above wave action as soon as possible.

The superstructure on the upper end of the caisson serves as a reaction point for the platform hoisting effort. Each jacking unit also has a cylinder and piston on opposite sides of a jacking leg. These are operable to cause the slips to incrementally raise the platform on the suspended jacking legs in response to the hoisting effort and to hold it in its raised position relative to the support. The slips also function automatically to hold the platform in any position to which it is raised by wave action. Thus, the slips not only take advantage of wave action, but at all times prevent the platform from dropping back onto the water. The jacking mechanisms can be operated simultaneously to raise the platform above the water, or be individually operated for leveling the platform, etc. After the platform has been raised to the desired height, it is welded to the caissons in a well known manner. The jacking units are then disconnected and removed, as are also the temporary struts. Drilling operations can then proceed.

The present method and apparatus are designed especially for use at sea in deep water of a depth of 550 feet or more, and to withstand 105-foot waves and high wind velocities of up to 125 miles per hour. The present platform may be elevated high enough above mean water level to be certain that it will be clear of wave action during severe storms.

There is presently an urgent need for off-shore well-drilling equipment that can be fabricated and installed with minimum costs, particularly in deep and rough waters. The hazards and tremendous costs involved in setting up drilling platforms, for example, in the North Sea area are well known. Similar problems exist in many other areas which are known to have oil and gas producing potential. While current higher oil and gas prices encourage exploration even in marginal fields, each venture must be weighed in light of the cost of equipment and the time and expense involved in installing the platforms and becoming operative.

The "weather window" is always a critical factor because delays at sea can be financially disastrous. This will be self-evident in situations where a derrick barge and its crew of 90 to 150 men are on hand to install the platform, but must remain idle because of the inability to cope with waves as high as only 7 feet, which would not halt operations under conditions involving a rig that is equipped with adequate berthing and jacking facilities, such as are provided by the present invention. The services of a derrick barge, such as that described above, may cost as much as $250,000.00 per day, even when idle because of unfavorable wind and sea conditions. Thus, it can be readily seen that the elimination of one or more derrick barges can save millions of dollars.

The reduction in height of the present jacking devices, compared to prior devices of the same capacity, not only saves many tons of steel in fabrication, but also results in additional great savings of many more tons of steel because the caissons can be made substantially shorter than would be required for taller jacking devices. The design of the caisson footings, which resist horizontal shear, and the requirement for a minimum of piles to firmly anchor the support to the sea bed, contribute to additional substantial savings in steel and lower over-all costs. The platform, in addition to being provided with crew's quarters, and all necessary equipment for well drilling operations, also carries all construction materials and equipment needed for completion of the installation, including cranes, underwater pile driving hammers, air compressors, concrete mixers, concrete ingredients and concrete pumps, electric welders, electric generators for generating electricity for the welding equipment, lights, motors, etc. All materiel not needed after the support and platform have been permanently installed is removed from the platform. Hence, the need for supply lighters or barges for construction purposes is also eliminated, resulting in further substantial savings in time and money. The economies effected by the foregoing make is possible to drill not only in deep water areas of good productivity, but also in areas that may be classified as marginal.

Accordingly, the principal object of the invention is to provide a method and simplified apparatus for safety elevating an off-shore platform on a support to a desired working height in a minimum of time, thereby effecting great savings in costs.

An important object is to provide a jacking unit that is of greatly reduced height, and requires much less steel, and costs a great deal less then prior jacking devices of the same capacity.

Another object is to provide a jacking unit that lends itself to a simpler method of setting up and rendering the same operable than has heretofore been known.

Another object is to provide a jacking unit and method wherein load stresses between the piston and cylinder actuating means therefor are absorbed and substantially evenly distributed by novel elastomeric means.

Another object is to provide means and a method for stabilizing an upright support in deep water that will prevent strong winds and high waves from knocking over the support before it is firmly anchored to the sea bed.

Another object is to provide a method and apparatus for jacking up a platform on a support comprising bottomed caissons, wherein the platform is manoeuvered into berthing position relative to the support, and the jacking apparatus is rendered functional without requiring substantial "set up" time.

Another object is to provide a method and apparatus for elevating a platform on a plurality of caissons, which employs the novel technique of utilizing a superstructure, or jacking head, on the upper end of the caissons as a load-reaction and bearing point for the platform jacking effort, and which effort is also applied directly to the platform.

A further object is to provide a method of erecting a prefabricated multiple-leg support structure, comprising a plurality of caissons on a sea bed in an upright position and moving a prefabricated platform into position to be elevated and supported on the caissons, characterized by pre-positioning the jacking units on the platform so that the upper end of the jacking legs thereof can be quickly raised into a holding means above the caissons; and jacking operations commenced immediately after all of the jacking legs are so held.

A still further object is to provide a platform with self-elevating jerking units mounted thereon, with each jacking unit having a single jacking leg prepositioned to be connected with and suspended from a superstructure above a caisson.

Still another object is to provide a platform with a system of self-energizing jacking units embodying "fail safe" features, so that, once the operation of jacking up the platform on the caissons has been started, the platform cannot accidentally drop back onto the water.

Still another object is to provide a platform jacking system including a jacking mechanism constructed so that during a jacking operation, if the platform is raised relative to a caisson by wave action, the jacking mechanism will automatically hold the platform in its raised position on the caisson and prevent it from moving downwardly as the wave action subsides.

A still further object is to provide a platform having caisson wells with at least one pair of jacking units at each well.

Still another object is to provide a jacking mechanism to be used with a jacking leg, including two holders, each containing a set of one-way wedge slips arranged so that the holders can be moved freely only in an upward direction relative to the jacking leg.

Still another object is to provide a stabilizing and shear-resisting piling arrangement for a support.

Other objects and advantages of the invention will be apparent from the following description taken in conjunction with the accompanying drawings.

DESCRIPTION OF THE DRAWINGS

FIG. 9 is a schematic plan view of the support and platform, illustrating the manner in which the support guy lines and anchor guy lines are connected with the support and the platform, respectively, and depicting the manner in which the cables and winches on the platform are arranged to effect berthing of the platform between the caissons of the support.

FIG. 18 comprises cross-sectional views diagrammatically showing how the elastomeric fender may be distorted under a perpendicular impact force during the berthing operation.

FIG. 19 is a similar view, illustrating possible fender distortion under an angular impact force applied during the berthing operation.

FIG. 20 is a perspective view of the upper end of one of the aft caissons showing a sheave and a fairing for one of the support guy lines mounted upon a superstructure.

Specifically, FIG. 37 shows the relative position of the slip housings at the start of a jacking operation, that is, with the lower slip housing in condition to raise the upper slip housing into engagement with the nuts on the lifting rods;

FIG. 38 shows the upper slip housing raised and with the slips thereof in gripping contact with a jacking leg, and with the lower slip housing in condition to be raised into engagement with the upper slip housing; and FIG. 39 shows the lower slip housing in its raised position with the slips thereof gripping the jacking leg and in condition to start a jacking and platform elevating stroke by raising the upper slip housing, lifting rods and platform to the position shown in dot-and-dash lines.

DESCRIPTION OF THE PREFERRED EMBODIMENTS

Figures 1, 2, 3:
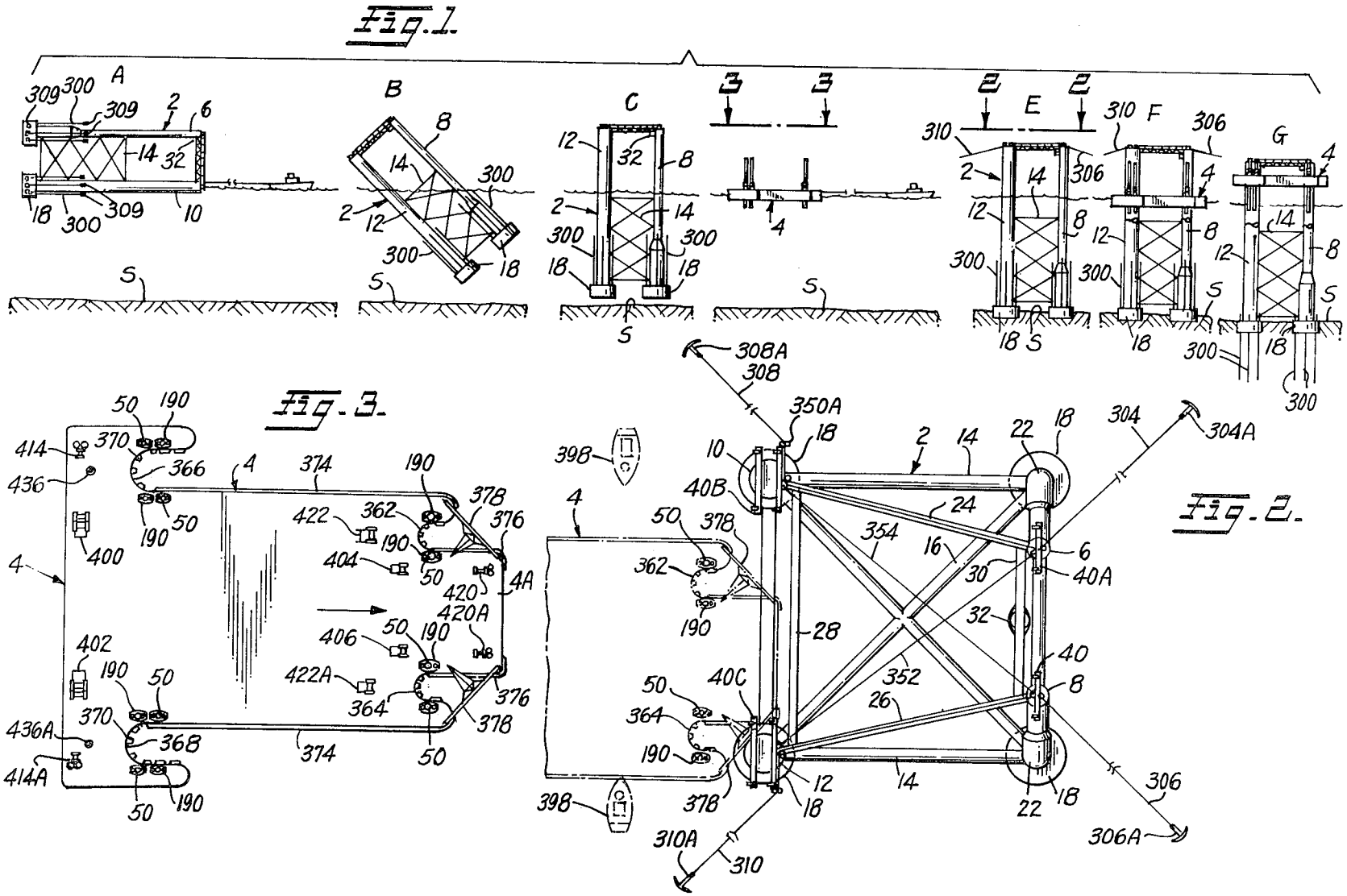
FIG. 1 comprises a series of schematic views illustrating the steps in the method of manoeuvering the support and erecting an off-shore drilling and production platform thereon, in accordance with the present invention.
FIG. 2 is a schematic plan view of the support and stabilizing guy anchor lines therefor, as viewed on the line 2—2 of FIG. 1, and exaggeratingly showing in dot-and-dash lines the manner in which temporary fenders on the bow of the platform can serve to guide the platform in proper berthing relation to the support.
FIG. 3 is a schematic plan view of the drilling platform as viewed on the line 3—3 of FIG. 1, with the locking gates omitted.

FIG. 1 of the drawings schematically illustrates the two principal components of the apparatus, and the successive steps involved in the method of erecting an off-shore well-drilling platform in accordance with the present invention. The two components are: a prefabricated support 2, and a prefabricated platform 4. The support comprises two fore caissons 6 and 8, and two aft caissons 10 and 12, rigidly interconnected by X-frame members 14 and internal braces 16. The designation of certain of the caissons as "fore" and "aft" is for convenience in identification and not by way of limitation. The caissons 6, 8, 10 and 12 (FIG. 2) and the frame members 14 are geometrically arranged to form a rectangle. Each caisson has an enlarged footing 18 at its lower end to engage, be embedded in and anchored to the sea bottom by piles, as will be described later. Conductor pipes (not shown) are installed in the aft caissons 10 and 12 during fabrication, since this will save a great deal of time later in getting started with the drilling operations. The ends of all of the caissons are sealed watertight so that the support 2 will float horizontally and can be towed to the drilling site by a tug 20. All of the caissons have flood valves (not shown) enabling the caissons to be filled at the drilling site with sea water and gradually tilted upwardly from a horizontal to a vertical position, as illustrated in FIG. 1 at A and B, respectively. The filling of the caissons causes the support structure to sink, as shown at C. When the footings 18 are about 25 feet above the sea bed S, tugs may be connected to the support 2 to turn it, if necessary, so that the caissons are disposed in the proper azimuth. Flooding of the caissons is continued until the footings 18 are bottomed on the sea bed S, as shown at E.

Figure 7:
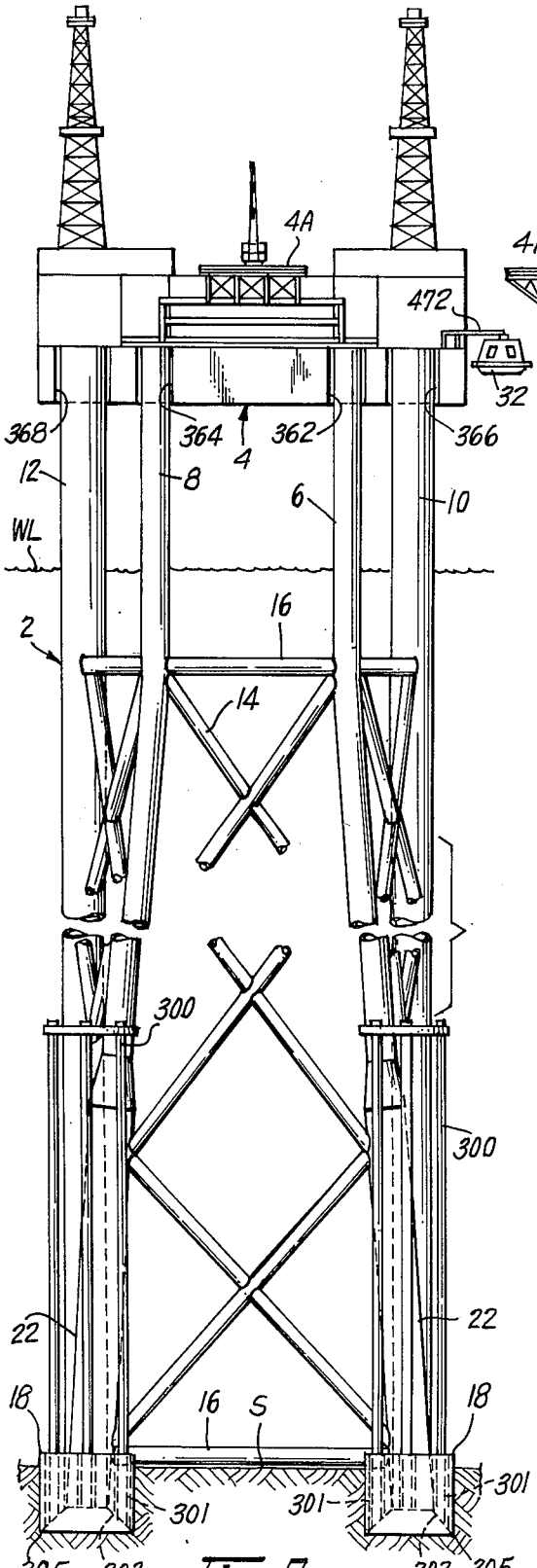
FIG. 7 is an elevational view of the fore end of the support with the platform in its elevated position, and particularly showing the piles that are to be driven through the caisson footings.

The caissons 6, 8, 10 and 12 are of a predetermined length, such that, when the suport 2 is sunk and anchored to the sea bottom, as shown at G, their upper ends project above the water to a height slightly greater than the working height to which the platform 4 is to be elevated. The fore caissons 6 and 8 are smaller in diameter at their upper ends than the aft caissons 10 and 12, as is best shown in FIG. 7, and are also closer together. Further, the lower portions 22 of the caissons 6 and 8 are enlarged and diverge downwardly and outwardly from a point well below the water line WL. The lower portion 22 of the caissons 6 and 8 is of the same diameter as the caissons 10 and 12. The lower ends of all of the caissons are the same distance apart, which provides a very stable support structure.

It will be noted from FIG. 7 that the caissons 6, 8, 10 and 12 extend for a substantial part of their length beyond the X-framing 14. In order to avoid cantilever stresses in the caissons while the support is disposed horizontally, the upper ends of the caissons are interconnected by temporary struts. Thus, caissons 6 and 10 are connected by a strut 24 (FIGS. 2 and 9). Caissons 8 and 12 are connected by a strut 26. These are connected by transverse struts 28 and 30. Each strut has a walkway 31 thereon to enable personnel to readily get from one caissons to another to perform various rigging functions. A swinging control cabin 32 is suspended beneath the strut 30 and is manner while the support 2 is being towed to the drilling site.

Figure 21:
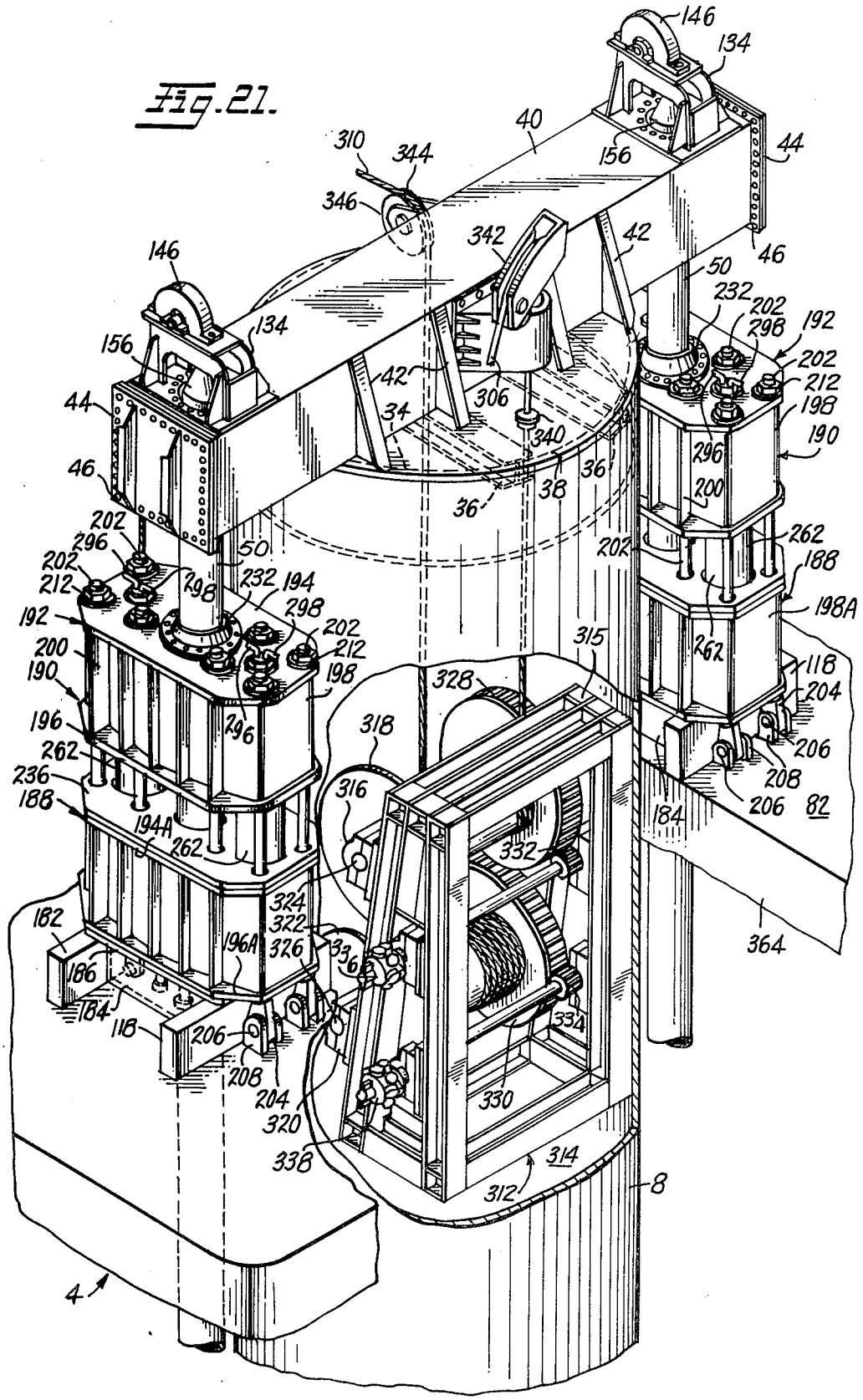
FIG. 21 is a perspective view of the upper end of one of the fore caissons, showing a jacking mechanism and the superstructure for receiving the upper end of a pair of jacking legs, and also schematically illustrating one of the remotely controlled double winches, to which two of the support guy lines are connected.

The upper end of each caisson 6, 8, 10 and 12 is reinforced by an internal ring 34 welded thereto, as shown for example in the caisson 8 (FIG. 21). Additional reinforcing I-beams 36 are welded within the ring 34 with the upper web thereof flush with the upper edge of the caisson 8. A circular plate 38 is mounted upon and welded to the upper edge of the caisson 8. A hollow box-like beam or superstructure 40 is permanently welded to the plate 38 and braced by gussets 42. A similar superstructure 40A, and two similar superstructures 40B and 40C (FIGS. 4 and 9), are welded to plates 38A, 38B and 38C, respectively, mounted upon caissons 6, 10 and 12, respectively. The plates 38B and 38C are preferably spot-welded in place since they must be removed later to provide access to drilling conductor pipes (not shown) in the caissons 10 and 12. Each of the foregoing superstructures has sealed, removable end plates 44 secured thereto by bolts 46 to afford access to the interior thereof.

Figure 30:
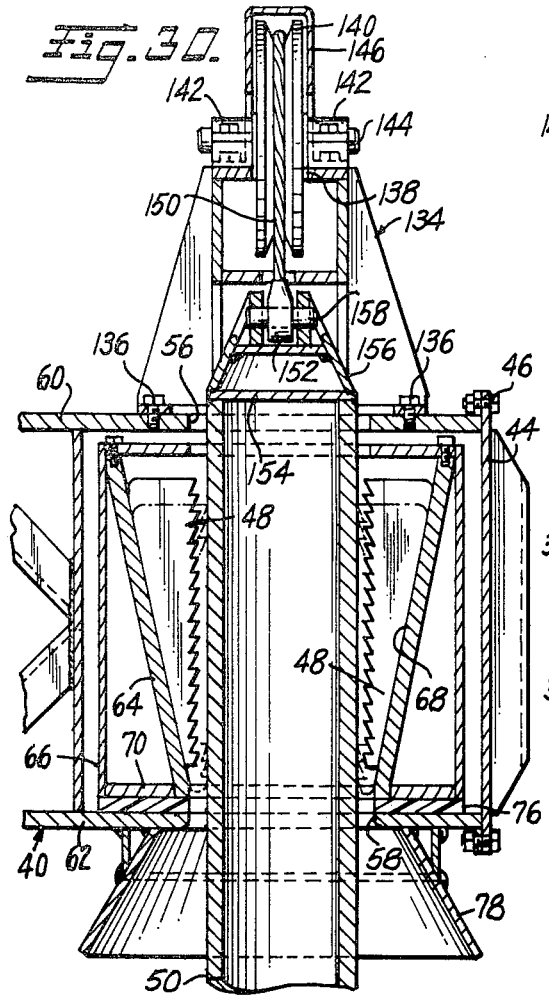
FIG. 30 is a vertical sectional view taken on the line 30—30 of FIG. 29.
Figure 29:
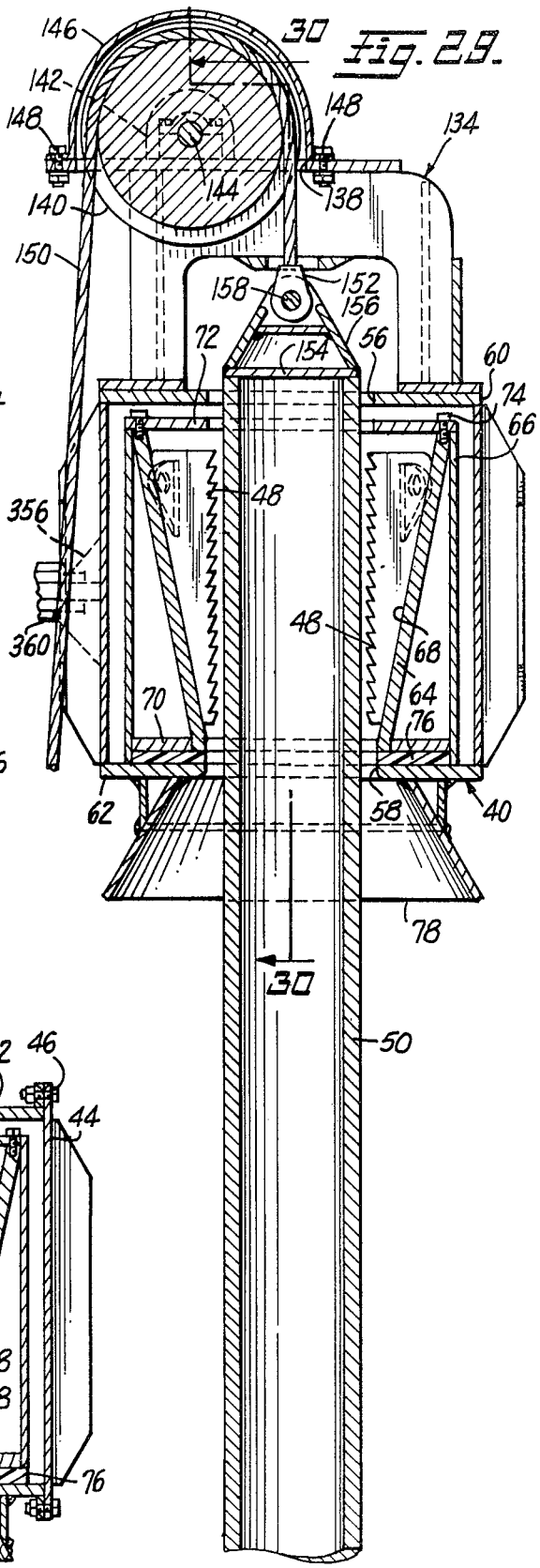
FIG. 29 is a vertical sectional view through the superstructure showing the slip-protecting covers removed, and an alternative, or auxiliary, means for raising the jacking legs into the holding slips.
Figure 28:
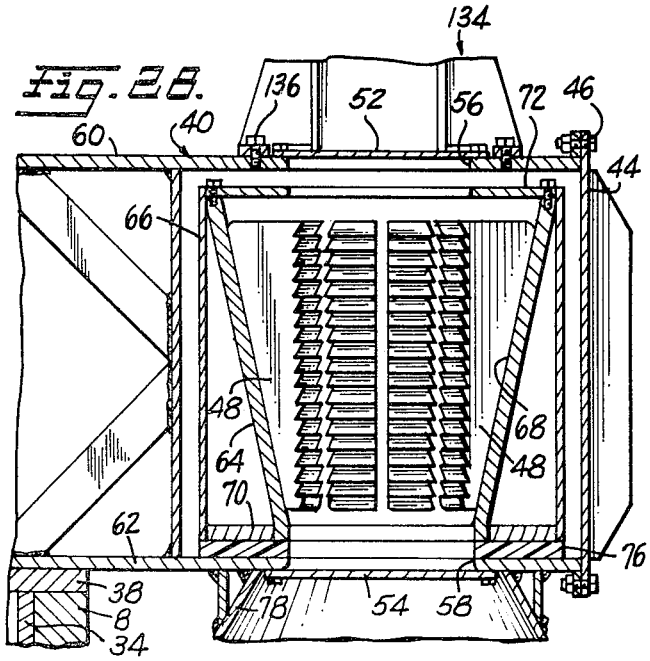
FIG. 28 is a fragmentary sectional view through one of the superstructures showing a set of holding slips and covers for protecting the slips from sea water during towing of the support.
Figure 31:
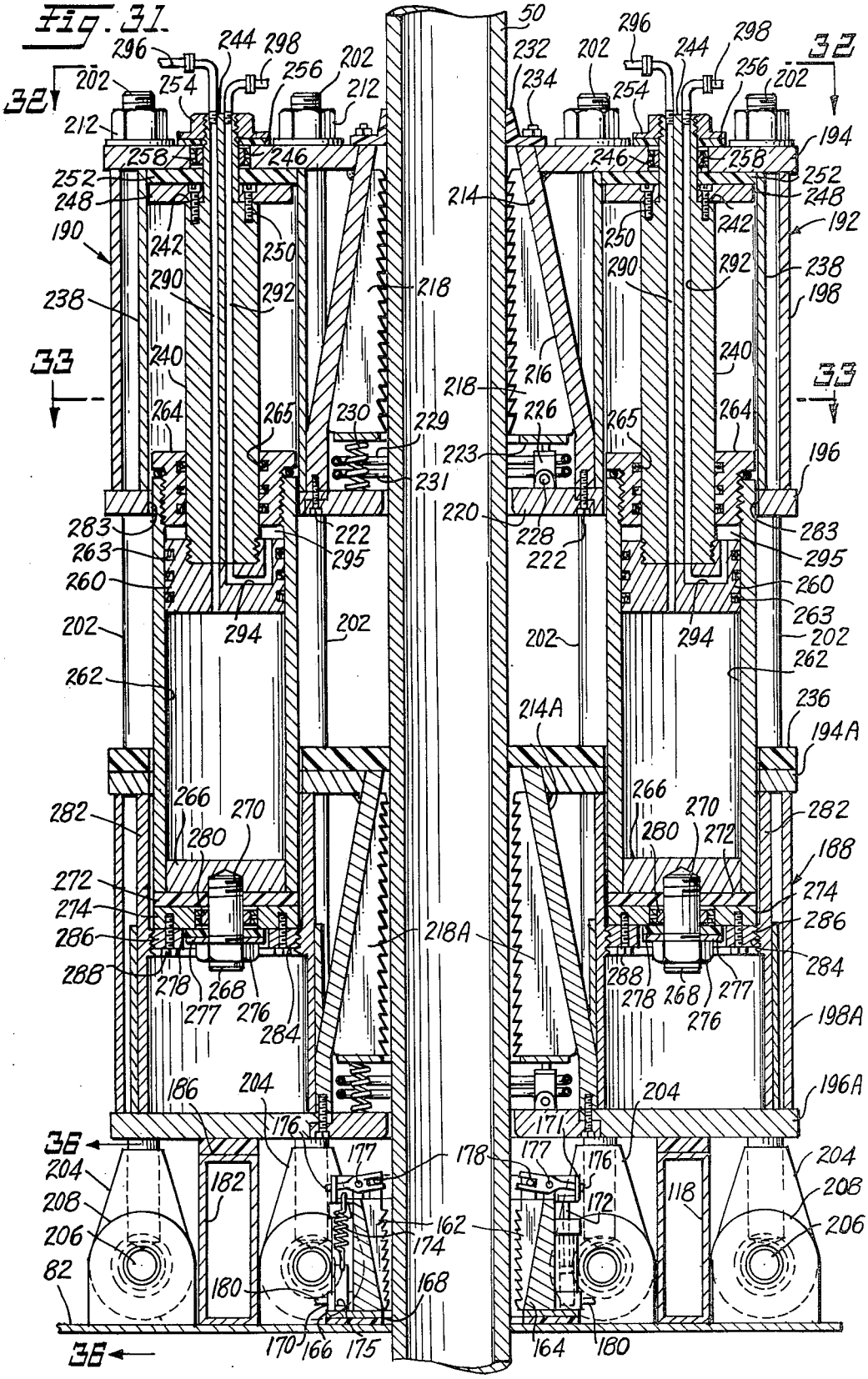
FIG. 31 is a vertical sectional view, taken on the line 31—31 of FIG. 32, through one of the jacking units illustrating the two slip holders and their associated actuating cylinders, and showing the deck slips on the platform in their retracted position.

Each superstructure contains two sets of self-energizing holding slips 48, one of which is shown in FIGS. 28 to 30. The holding slips 48 are located at the opposite ends of each superstructure and in a region outwardly of its associated caisson. Each set of holding slips 48 receives the upper end of a jacking leg 50, as will be described more fully later. These slips are protected from sea water as the support 2 is being towed to the drilling site by sealed plates 52 and 54 mounted across upper and lowe aligned openings 56 and 58, respectively, in the top and bottom walls 60 and 62, respectively, of the superstructure. As is shown, a slip holder 64 is mounted in a cylindrical shell 66 and has an internal frusto-conical surface 68, the walls of which converge downwardly. The slips 48 are conventional and are arranged so that they completely surround the jacking leg 50 after it has been inserted therein. The lower end of the slip holder 64 and the shell 66 are welded to a ring 70. The slips 48 are retained in the slip holder 64 by a ring 72 that is fastened to the upper end of the holder by bolts 74. The entire holder assembly rests upon an elastomeric pad 76 that may be bonded to both the holder assembly and the wall 62. The pad 76 permits angular movement of the jacking leg 50, as will be referred to hereinafter. After the support 2 has been tilted into an upright position and the platform 4 has been berthed, the cover plates 52 and 54 are removed to permit the jacking leg 50 to be raised into the holding slips 48 and to be suspended by said slips. If desired, a conical guide 78 may be mounted on the lower wall 62 of the superstructure to guide the upper end of the jacking leg 50 into the slip holder 64.

Figures 24, 25, 26, 27:
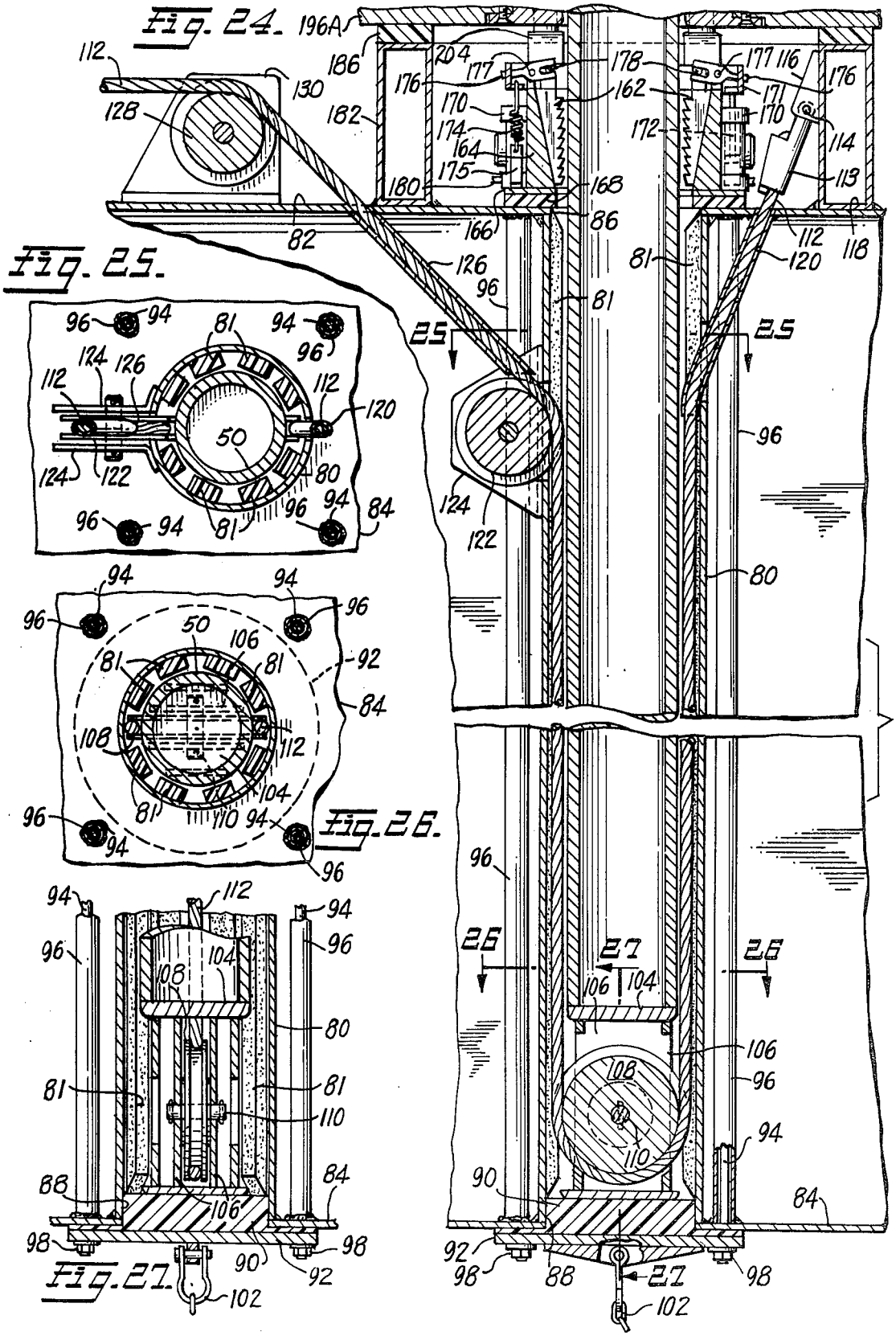
FIG. 24 is a fragmentary vertical sectional view illustrating deck safety slips, for a jacking leg, and one cable arrangement that can be used for lowering and raising a jacking leg relative to the platform.
FIG. 25 is a horizontal sectional view, taken on the line 25—25 of FIG. 24, particularly showing the elastomeric fenders in the jacking leg sleeve.
FIG. 26 is a horizontal sectional view taken on the line 26—26 of FIG. 24.
FIG. 27 is a fragmentary vertical sectional view taken on the line 27—17 of FIG. 24, showing the cable sheave at the lower end of the jacking leg.

Referring to FIG. 24, each of the jacking legs 50 is mounted in an open-ended sleeve 80 that extends from the deck 82 of the platform 4 to the bottom wall 84 of the platform and is welded in place at both ends. The jacking leg 50 is cushioned in the sleeve 80 against damage by longitudinal, elastomeric fenders 81, which extend for the full length of the sleeve.

The jacking leg 50 is tubular and is closed at its lower end by a disc 104 (FIGS. 24 and 27) to which spaced brackets 106 are secured for receiving a sheave 108 therebetween. The sheave 108 is mounted upon a pin 110 received in the brackets 106. One end of a cable 112 is received in a cable socket 113 that is secured by a pin 114 to a bracket 116 welded to a box-beam 118 mounted upon the platform deck 82. The cable 112 extends through a tube 120 downwardly into the sleeve 80 for the jacking leg 50, around the sheave 108 and then upwardly around another sheave 122 mounted in spaced brackets 124 secured to the outer side of the sleeve 80. The cable 112 then continues through a tube 126, through the deck 82, and over a sheave 128 supported by brackets 130 mounted upon the platform deck 82. The other end of the cable 112 extends to a winch 132 (FIG. 10), which is operable to take up the cable 112, after berthing of the platform 4, and thereby raise the jacking leg 50 upwardly into engagement with the holding slips 48 in its associated superstructure.

The deck 82 has an opening 86 to permit entry of the jacking leg 50 into the sleeve 80. The bottom wall 84 has an opening 88 at the lower end of the sleeve 80. The opening 88 is closed and sealed water-tight by an elastomeric plug 90 bonded to a metal cover 92. The cover 92 is detachably secured in place by long bolts 94 that extend through the deck 82, tubes 96, the bottom wall 84 and into nuts 98 welded to the cover 92. The tubes 96 are weled water-tight at their opposite ends to the deck 82 and bottom wall 84, respectively. The bolts 94 have heads 100 at their upper end that are accessible from the platform deck, as will be described hereinafter. A retrieval chain 102 connects the cover 92 to the bottom wall 84. An alternative or stand-by arrangement for raising the jacking legs 50 is shown in FIGS. 29 and 30. Thus, a bracket 134 is fabricated from metal plates and secured to the top wall 60 of each superstructure by bolts 136. The bracket 134 has a central opening 138 to receive a sheave 140. Bearings 142 are mounted on the bracket 134 on opposite sides of the opening 138 and a shaft 144 mounted in the bearings 142 supports the sheave 140. The sheave 140 is enclosed by a semicircular housing 146 secured by bolts 148 to the top of the bracket 134. A cable 150 extends around the sheave 140 and has a clevis 152 secured to one end thereof. The cable 150 is fed over the sheave 140, and through the holding slips 48, until the clevis 152 is at the level of the upper end of the jacking leg 50. In this instance, the jacking leg 50 is closed at its upper end by a welded plate 154 to which is attached a conical bracket 156 designed to receive the clevis 152 so that a pin 158 can be inserted into the bracket 156 and clevis 152 to secure the cable 150 to the jacking leg 50. The other end of the cable extends around a sheave 159 (FIG. 11) and is connected to a reversible winch 160, both of which are mounted on the platform deck 82. As the winch 160 is operated to take up the cable 150, the jacking leg 50 will be pulled upwardly into the slip holder 64 to the position illustrated in FIGS. 29 and 30. The holding slips 48 are engaged with the jacking leg 50 and, upon reversing the winch 160 to release the tension on the cable 150, the weight of the jacking leg 50 will be transferred to the slips 48, which automatically tightly grip the jacking leg 50, suspending it and positively preventing downward movement thereof. All of the jacking legs 50 can be raised into their associated superstructures by following the procedure described above regardless of wind and wave conditions. After a given jacking leg 50 has been positioned in a set of holding slips 48, the cable 150 is disconnected.

Irrespective of whether the jacking leg raising system shown in FIG. 24, or that shown in FIGS. 29 or 30, is used, the jacking lets 50 are held in the sleeves 80, while the platform 4 is in tow, by a set of deck slips 162 (FIGS. 24 and 34) mounted in a slip holder 164. The holder 164 is fastened to a ring 166, which rests upon an elastomeric pad 168*k* both of which are secured to the deck 82. A hydraulic cylinder 170 (FIG. 34) is mounted on the holder 164 in radial alignment with deck slips 162. A plunger 172 extending from each cylinder 170 is connected to a lug on a ring 171, which has openings with suitable clearance to operatively receive the free end of a forked lever 176 pivoted on the holder 164 at 177 and connected at 178 to each slip 162. A tension spring 174 is connected to a lug on the ring 171 between adjacent cylinders 170 and to a fixed bracket 175. The slips 162 are self-energizing and grip the jacking leg as a safety device to hold it steady in transit. The slips 162 can be retracted by the springs 174 upon releasing operating fluid from the cylinders 170 through conduit 180 prior to jacking.

Figure 32:
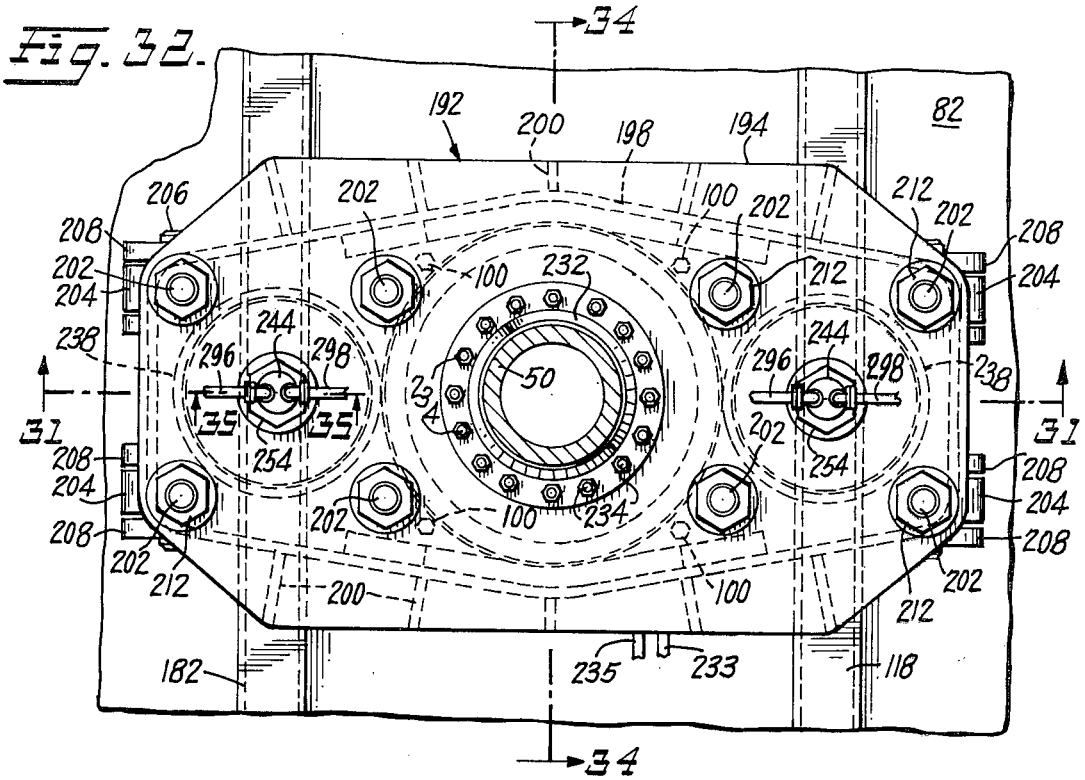
FIG. 32 is a plan view of the jacking unit as viewed on the line 32—32 of FIG. 31.
Figure 33:
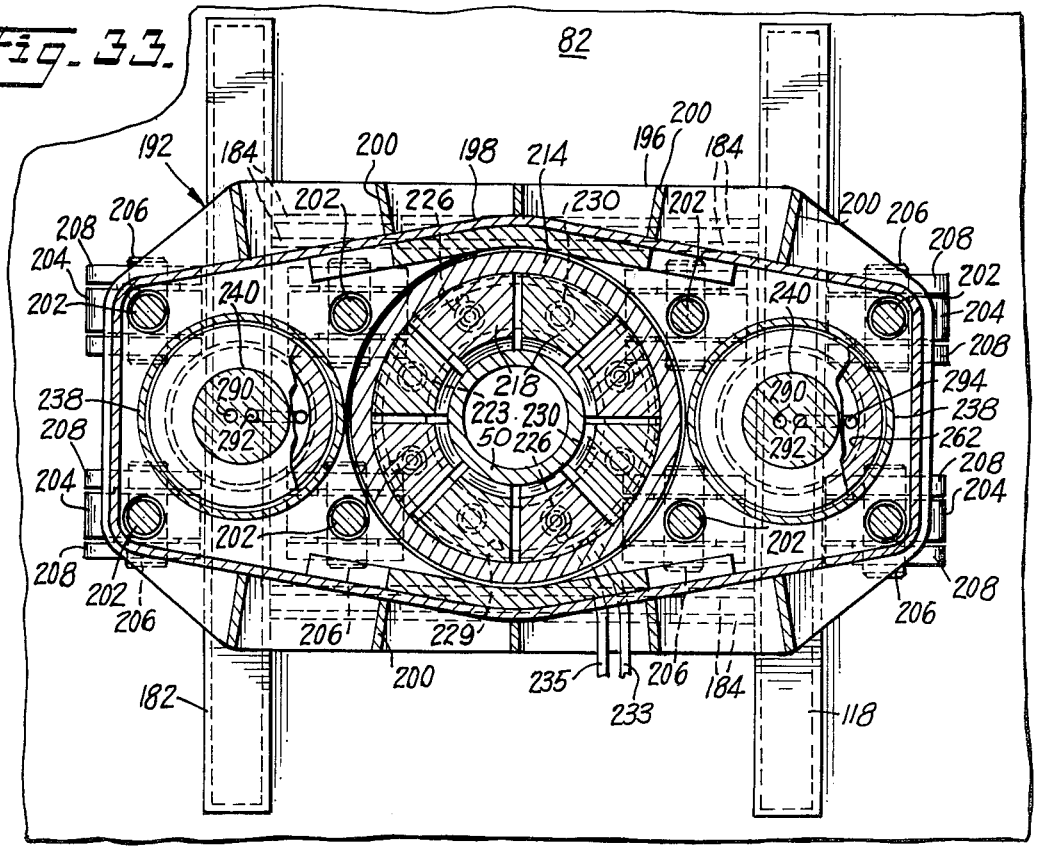
FIG. 33 is a horizontal sectional view taken on the line 33—33 of FIG. 31.
Figure 34:
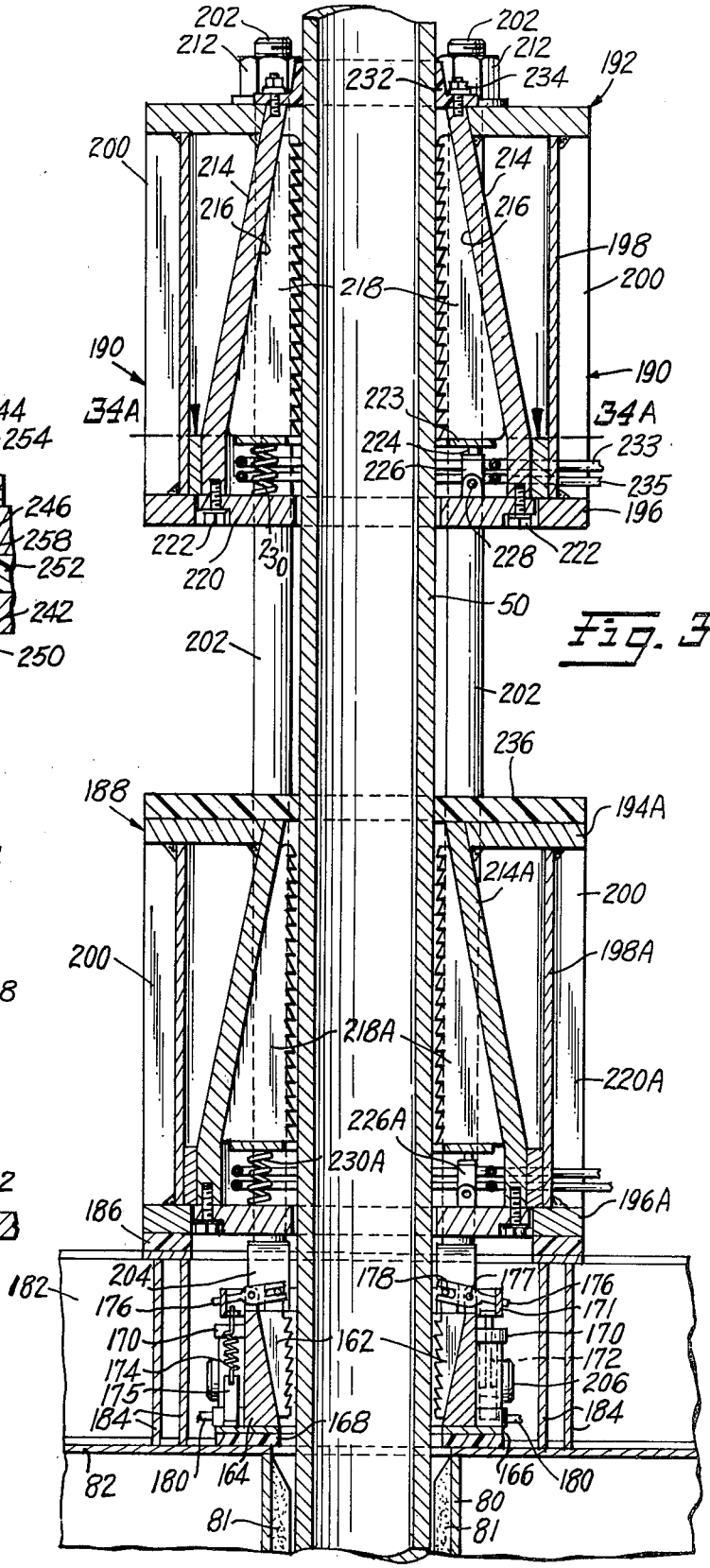
FIG. 34 is a vertical sectional view taken on the line 34—34 of FIG. 32.
Figure 34A:
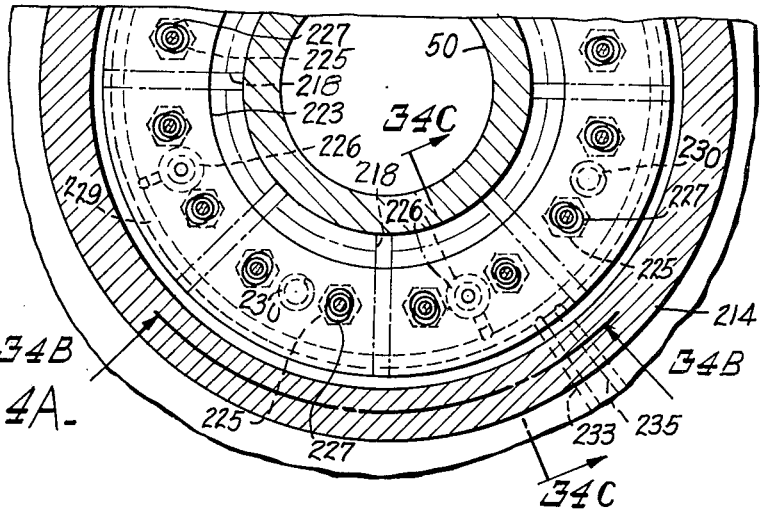
FIG. 34A is a fragmentary cross-sectional view taken on the line 34A—34A of FIG. 34, particularly showing a ring that is connected to the jacking slips, and the alternating arrangement of cylinders and compression springs associated with said ring.
Figure 34B:
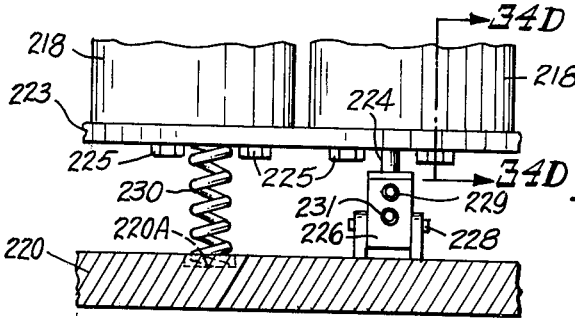
FIG. 34B is a fragmentary sectional view, taken on the line 34B—34B of FIG. 34A.
Figure 34C:
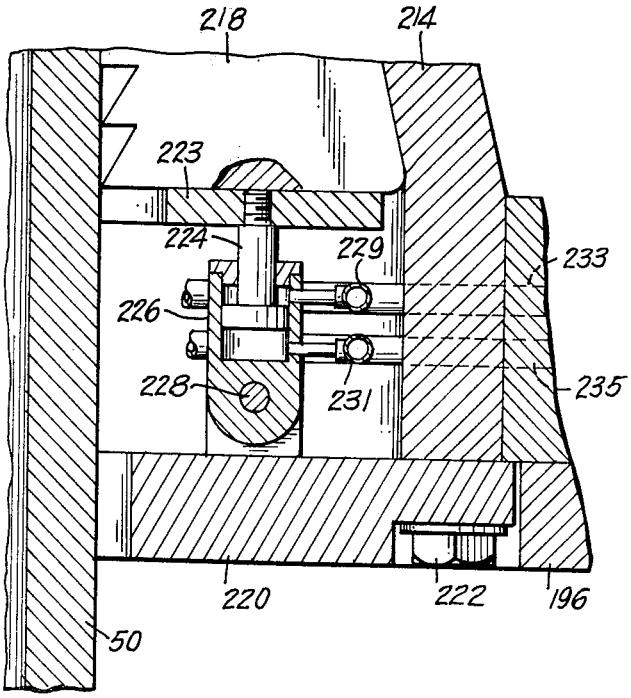
FIG. 34C is an enlarged fragmentary cross-sectional view, taken on the line 34C—34C of FIG. 34A.
Figure 34D:
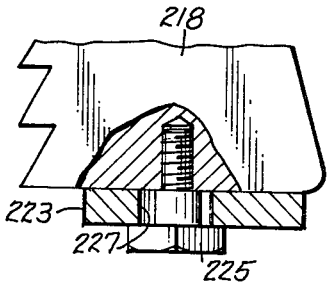
FIG. 34D is an enlarged fragmentary sectional view, taken on the line 34D—34D of FIG. 34B.

The slip holder 164 is enclosed and protected against the elements by the box-beam 118, a similar box-beam 182 disposed parallel thereto, and plates 184 welded therebetween, as will be understood from FIGS. 24 and 34. An elastomeric pad 186 is mounted upon the beams 118 and 182 and serves the dual purpose of a sealing means for the deck slips 162 and a cushion for the lower housing 188 of a jacking unit, or jacking mechanism, generally identified by the numeral 190 (FIGS. 31 to 34).

Figure 36:
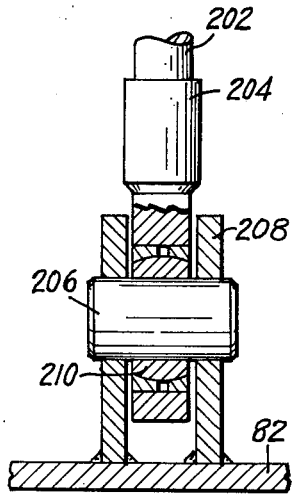
FIG. 36 is a fragmentary enlarged sectional view, taken on the line 36—36 of FIG. 31, illustrating the self-aligning bushing at the lower end of the lifting rod.

The jacking mechanism 190 comprises, in addition to the lower housing 188, a generaly similar upper housing 192. The housings 188 and 192 are similar and a description of one will suffice for both, except that the corresponding components of the lower housing 188 will be identified by the same numeral with the letter A added. The housing 192 comprises an upper plate 194, a lower plate 196, and a housing shell 198 between said plates, all welded together to provide a unitary, laterally elongated rigid structure. The shell 198 is reinforced by vertical webs 210 welded to the exterior thereof, as is best shown in FIGS. 32 and 33. Four lifting rods 202 are arranged in a group at each end of the housings 188 and 192 on diametrically opposite sides of the jacking leg 50 and extend through aligned openings in said housings. The lower end of each lifting rod 202 carries a socket 294 and is connected by a pin 206 to a bracket 208 welded to the platform deck 82. Each socket 204 contains a self-aligning bushing 210 mounted on the pin 206 (FIG. 36) so that the rods 202 can be tilted in any direction relative to the platform 4. A nut 212 is fastened to the upper end of each of the lifting rods 202 and serves as an abutment for the upper housing 192 during the jacking operation. The nuts 212 also retain the housings 188 and 192 in assembled relationship.

An upper slip holder 214 is welded in place between the upper and lower plates 194 and 196 of the upper housing 192. The slip holder 214 has a frusto-conical recess 216 containing a set of conventional, self-energizing wedge slips 218 surrounding the jacking leg 50. The lower end of the slip holder 214 is closed by a slip-retained ring 220 secured thereto by bolts 222. An actuating ring 223, (FIGS. 34, 34A, 34B, 34C and 34D) is attached to the lower end of each slip 218 by a shouldered bolt 225, which extends through an elongated and oversize opening 227 in the ring 223 to permit free radial and lateral sliding movement of the slips relative to the ring. A plunger 224 extends downwardly from the actuating ring 223 beneath alternate slips 218 into a double acting cylinder 226 pivotally mounted at 228 on the retainer ring 220. A compression spring 230 is disposed between adjacent cylinders 226 with its lower end seated in a socket 220A in the ring 220. The springs 230 normally urge the actuating ring 223 and the wedge slips 218 upwardly away from the retainer ring 220 so that their teeth are in engagement with the jacking leg 50. Operating fluid is supplied to the cylinders 226 through circular manifolds 229 and 231 and flexible supply conduits 233 and 235.

It is to be understood that the slips 218, as well as all other slips disclosed herein, are mounted in their slip holders with a T-bar guide (not shown) attached to the holder between adjacent slips to provide for lateral separation of the slips while maintaining the slips vertical and assuring uniform movement thereof. The cylinders 226 primarily serve to retract the slips 218 against the force of the springs 230, as when the jacking legs 50 are being raised prior to the jacking operation. A wiper seal 232 surrounds the jacking leg 50 and is secured to the upper plate 194 by bolts 234 to prevent water, etc. from getting into the upper slipholders 214.

A lower holder 214A for a similar set of slips 218A is mounted upon a lower housing plate 196A in the same manner as the upper slip holder 214. The lower set of slips 218A is urged upwardly in the holer 214A by a spring 230A, arranged similar to the spring 230 described above. A pad 236 of elastomeric material is mounted on the upper plate 194A of the lower housing 188 and fits closely around the jacking leg 50. It serves as a cushion between the upper and lower housings 192 and 188, respectively, and prevents water and other matter from entering the lower slip holder 214A. It will be noted that the teeth on the upper and lower sets of wedge slips 218 and 218A are designed somewhat like a saw-tooth so that they are caused to automatically grip the jacking legs 50 at any time that the jacking mechanisms 190 should attempt to move downwardly relative to the jacking legs 50. On the other hand, the slips 218 and 218A and the housings 188 and 192 of the jacking mechanisms 190 are permitted to move freely upwardly in sequence with respect to the jacking legs 50 without gripping the same.

Figure 35:
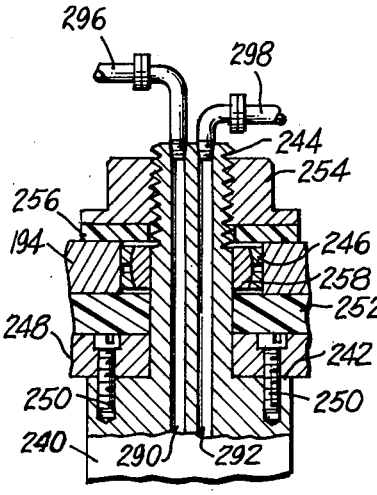
FIG. 35 is a fragmentary enlarged sectional view taken on the line 35—35 of FIG. 32, illustrating the manner in which the upper end of a piston guide in one of the cylinders is mounted in a swivel joint.

A cylindrical protective sleeve 238 is welded in place between the plates 194 and 196 of the upper housing 192 on diametrically opposite sides of the jacking leg 50 and concentrically within its associated group of lifting rods 202, as shown in FIGS. 32 and 33. Disposed within each sleeve 238 is a piston 240 having a shoulder 242, and a threaded extension 244 that projects through an opening 246 in the upper plate 194. A disc 248 is fastened to the shoulder 242 by bolts 250 and an annular elastomeric member 252 is disposed and confined in the space between the disc 248 and the housing plate 194. A flanged nut 254 is threaded upon the upper end of the extension 244. An elastomeric sealing member 256 is positioned and confined between the flange of the nut 254 and the upper plate 194 to provide a yieldable connection and to prevent water and other matter from entering the sleeve 238. The portion of the extension 244 disposed in the opening 246 has a self-aligning bushing 258, best shown in FIG. 35, mounted therein between the axially spaced elastomeric members 252 and 250. The self-aligning bushing 258 permits relative angular movement between the upper plate 194 and the piston 240, which is further facilitated by the elastomeric members 252 and 256, which are slightly axially-yieldable and permit some angular-flexibility to equalize stresses therebetween.

The lower end of the piston 240 has a head 260, which is reciprocable in a cylinder 262. Conventional packing 263 is mounted on the piston head 260. The upper end of the cylinder 262 is internally threaded and is closed by a flanged head 264 threaded thereinto. Conventional packing 265 in a bore in the head 264 forms a seal with the piston 240. The lower end of the cylinder 262 is closed by a plain head 266, which may be welded in place. A stud 268 is threaded into an opening 270 in the head 266. An elastomeric member 272 and a metal disc 274 are mounted on the stud 268 and are secured thereto by a nut 276. A metal washer 277 and an elastomeric washer 278 underlie the nut 276. A self-aligning bushing 280, similar to the bushing 259, is mounted on the stud 268 between the axially spaced elastomeric members 272 and 278. The self-aligning bushing 280 permits relative angular movement between the cylinder 262 and the lower jack housing 188, which is facilitated by the elastomeric members 272 and 278, which provide axial-yieldability and angular-flexibility to absorb and equalize stresses therebetween under load conditions. The cylinder 262 also extends into a protective sleeve 282 welded between the upper and lower plates 194A and 196A of the lower housing 188 concentric with a group of lifting rods 202. The sleeve 282 has internal threads 284 at a location about midway of its length. An externally threaded ring 286 is mounted in the sleeve 282. Bolts 288 connect the ring 286 to the metal disc 274. In this manner, the lower housing 188 is non-rigidly connected connected with the lower end of the cylinder 262, thus further providing for limited flexibility between the pistons 240 and the cylinders 262. and the jack housings 188 and 192. The cylinder 272 extends, with clearance, through an opening 283 in the lower plate 196 of the upper housing 192 and through similar openings in the pad 236 and upper plate 194A of the lower housing 188.

The extension 244 (FIG. 31), the piston 240, and the piston head 260 have two passageways 290 and 292. The passageway 290 extends through the piston head 260 and communicates with the cylinder 262; whereas, the passageway 292 is connected with a U-shaped passageway 294 in the piston head 260 and communicates with a space 295 between the piston head 260 and the cylinder head 264. Operating fluid is supplied to the passageways 290 and 292 through supply conduits 296 and 298. The manner in which the jacking mechanism 190 operates to elevate the platform 4 relative to the jacking legs 50 will be described in detail later.

The method and apparatus for stabilizing the support 2 will now be described.

Figure 8:
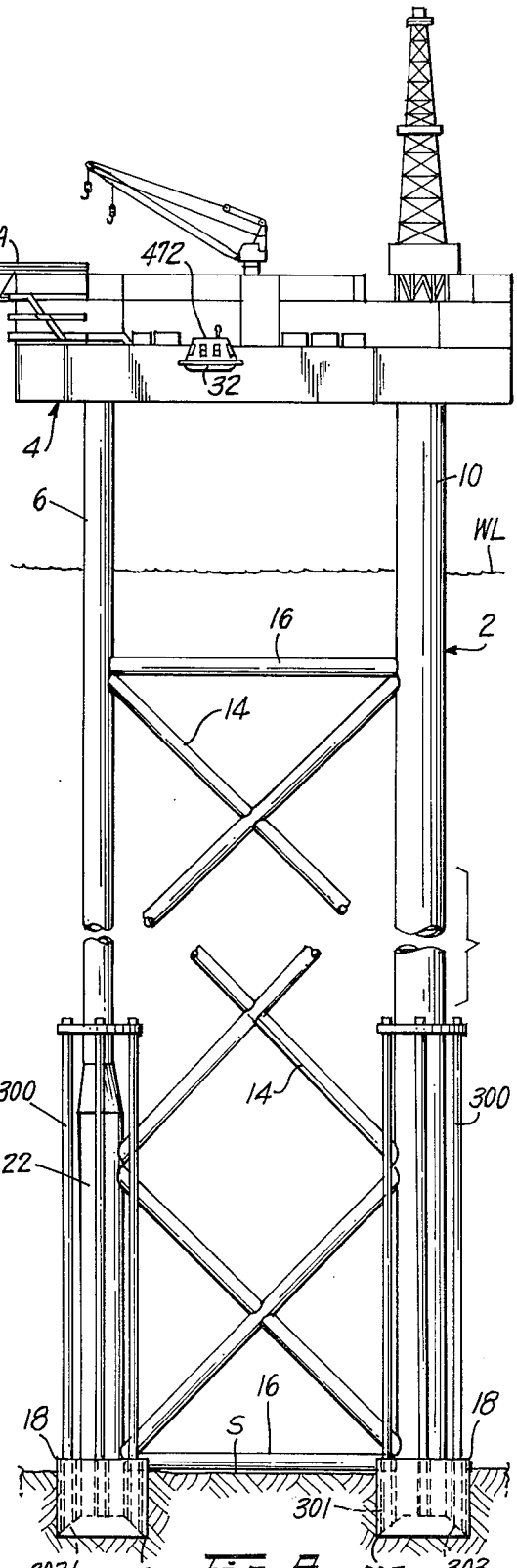
FIG. 8 is a right side elevational view of the structure shown in FIG. 7.
Figure 5:
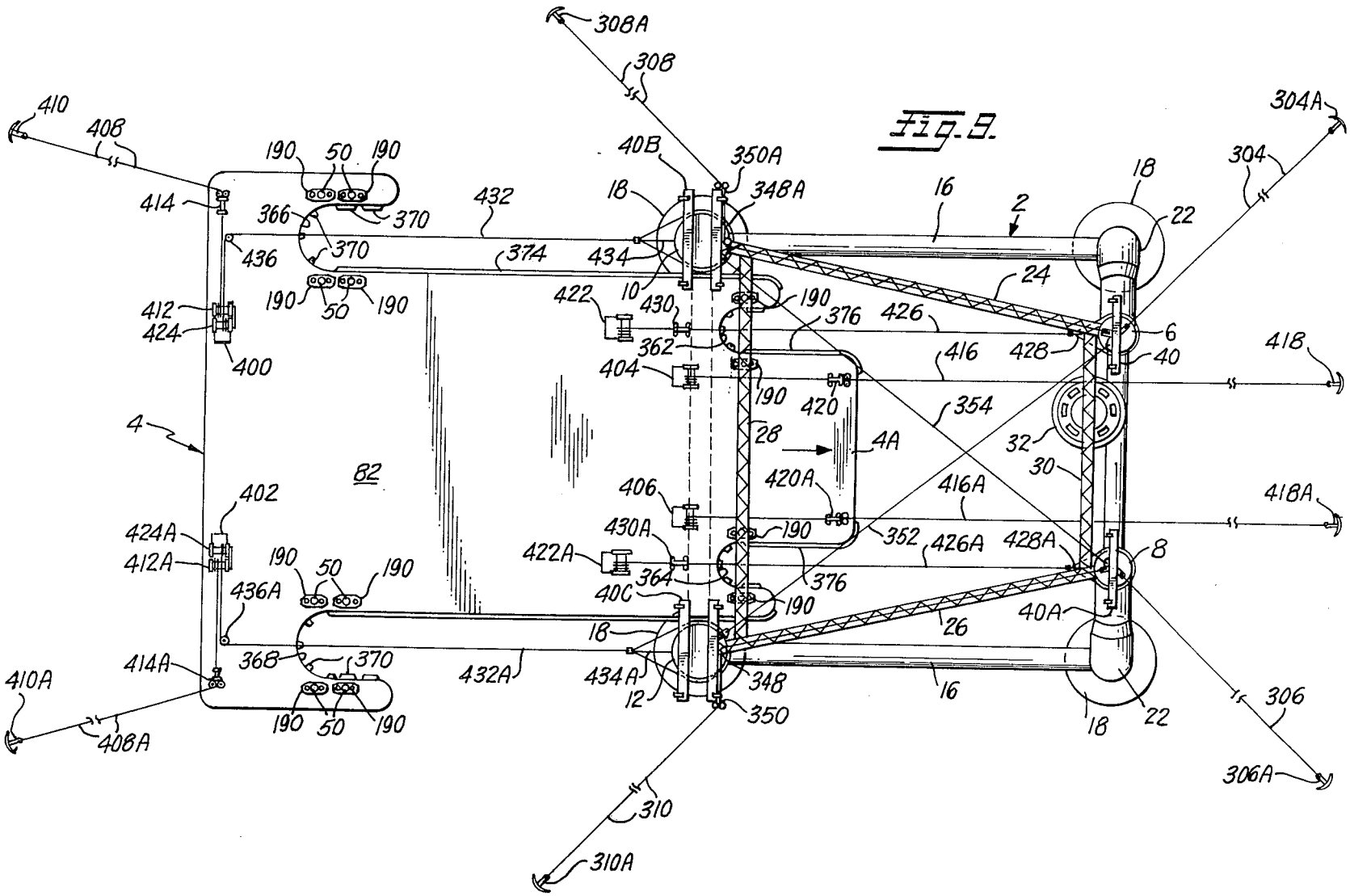

After on-shore fabrication of the support 2 has been completed, it is launched and towed to location on its side, with the larger caissons 10 and 12 lowermost. The buoyancy of the support 2 provides towing stability in the roughest seas. The caissons 6, 8, 10 and 12 will have already been provided with piles 300 disposed in sleeves 301 in the footings 18 (see FIGS. 7 and 8). The footings 18 have a bottom wall 303 that converges inwardly and upwardly to provide a sharp sea bed-penetrating edge 305. The piles 300 will be driven by known underwater pile hammers inserted into the tops of the piles 300 by known techniques.

The support 2 is preferably equipped with guy lines and anchors for later stabilizing the same, before it is launched. The support 2 is tilted up into a vertical position by successively flooding watertight bulkheads (not shown) within each caisson, as indicated at B in FIG. 1. The control equipment for flooding the caissons is contained in the manned cabin 32. The watertight bulkheads are located to provide stability throughout the operation. The support 2 is sunk until it is about 25 feet from sea bottom. The final positioning and any rotation that may be required are accomplished by tugs in order to set the support in the exact azimuth desired. Controlled flooding is continued until the support 2 rests upon the sea bed S, as indicated at E in FIG. 1. The sea bed S may be soft, in which case the footings 18 will sink several feet into the bed due to the dead weight of the support 2.

Figure 22:
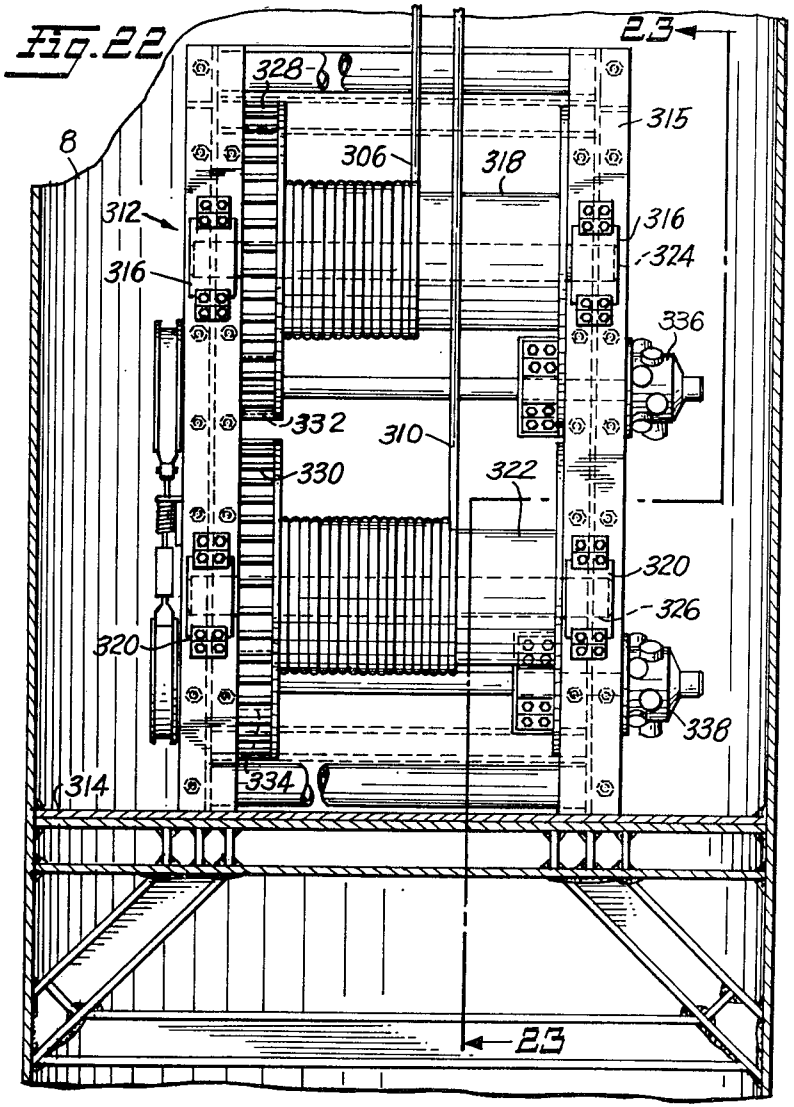
FIG. 22 is a front elevational view of the double winch showing further details thereof, with the caisson and supporting bulkhead shown in cross-section.
Figure 23:
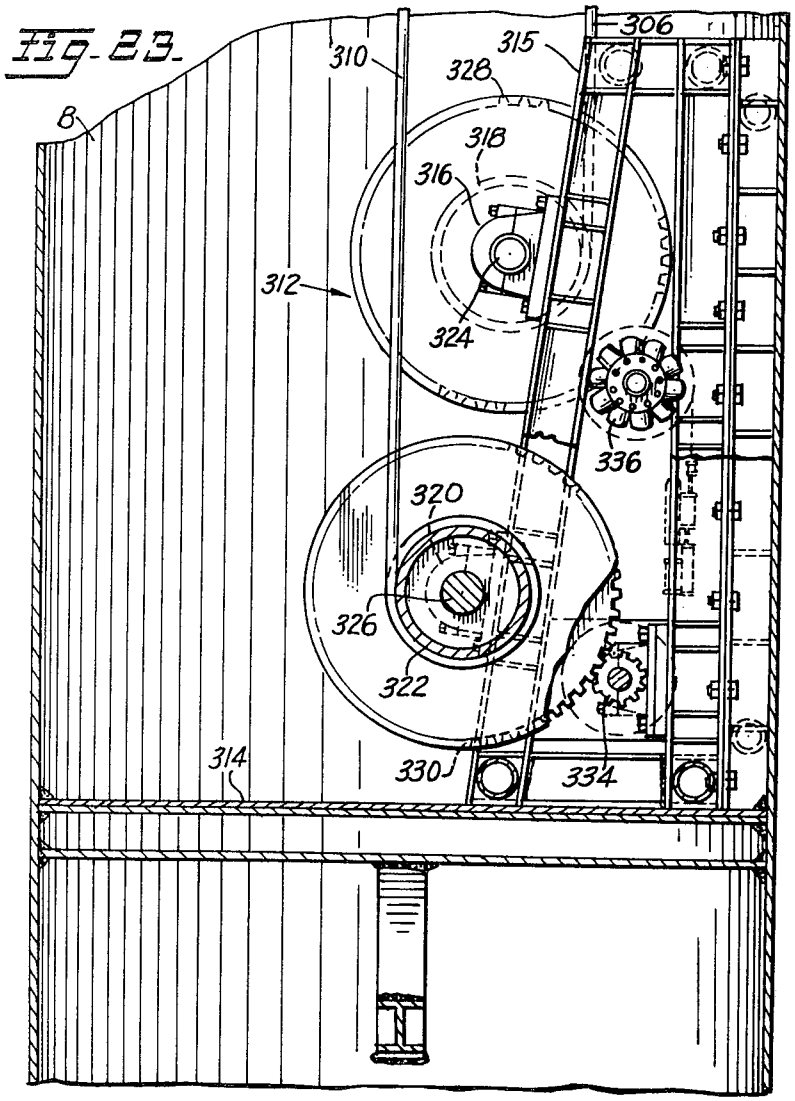
FIG. 23 is a staggered vertical sectional view taken on the line 23—23 of FIG. 22.

The upright support 2 is stabilized against wind and wave action by a pair of fore guy lines 304 and 306 (FIG. 4) and a pair of aft guy lines 308 and 310, each of which is premounted on the support 2 and attached at one end to an anchor chain and a heavy (30 ton) anchor 304A, 306A, 308A and 310A, respectively. The other ends of the guy lines are fastened to winches in the fore caissons 6 and 8, FIGS. 21 to 23. Thus, referring to FIG. 21, a portion of the plateform 4 and a portion of the fore caisson 8 is shown broken away to expose a double winch 312 that is mounted on the caisson wall and further secured to a bulkhead 314. The winch 312 comprises a fabricated frame 315 having bearings 316 that support an upper drum 318, and bearings 320 that support a lower drum 322. The upper drum 318 is mounted upon a shaft 324 and the lower drum is similarly mounted upon a shaft 326. Both shafts 324 and 326 carry large gears 328 and 330, respectively, that mesh with a pinion 332 and 334, respectively. The pinion 332 is driven by a reversible hydraulic motor 336. A similar motor 338 drives the pinion 334. The guy line or cable 306 is connected to the upper drum 318 and extends through a guide 340 in the plate 38 on the caisson 8 and through a conventional fairing 342 mounted upon the superstructure 40. The other end of the cable 306 is connected with a section of chain attached to the anchor 306A. The guy line or cable 310 is connected to the lower drum 322 and extends upwardly through the plate 38 and over a sheave 344 mounted in a bracket 346 mounted on the superstructure 40. The cable 310 extends from the fore caisson 8 to the aft caisson 12 on the same side of the support 2 and is threaded through a sheave 348 (FIG. 20) mounted on the superstructure 40C on top of the caisson 12. A conventional fairing 350 is also mounted on the superstructure 40C close to the sheave 348 and the cable 310 extends through the fairing 350 and has its other end connected to the anchor chain extending from the anchor 310A, FIG. 4.

It will be understood that a double winch 312A, similar to the winch 312, is mounted in the fore caisson 6 (FIG. 10), and that the guy line 304 is rigged through a fairing 342A and connected to an upper drum 318A in the same manner as the guy line 306; and further, that the guy line 308 is connected to a drum 322A and rigged through a sheave 344A; and a sheave 348A and fairing 350A on aft caisson 10 in the same manner as the guy line 310. The hydraulic motors for driving the drums 318, 322, 318A ad 322A are all controlled from the cabin 32 in a manner readily understood by those familiar with controls. The winches 312 and 312A are located a substantial distance below the upper end of the caissons 6 and 8 so that their supporting bulkheads 314 provide the maximum resistance against the bending forces that are imposed on the caissons 6 and 8 during berthing.

Figures 4, 5, 6:
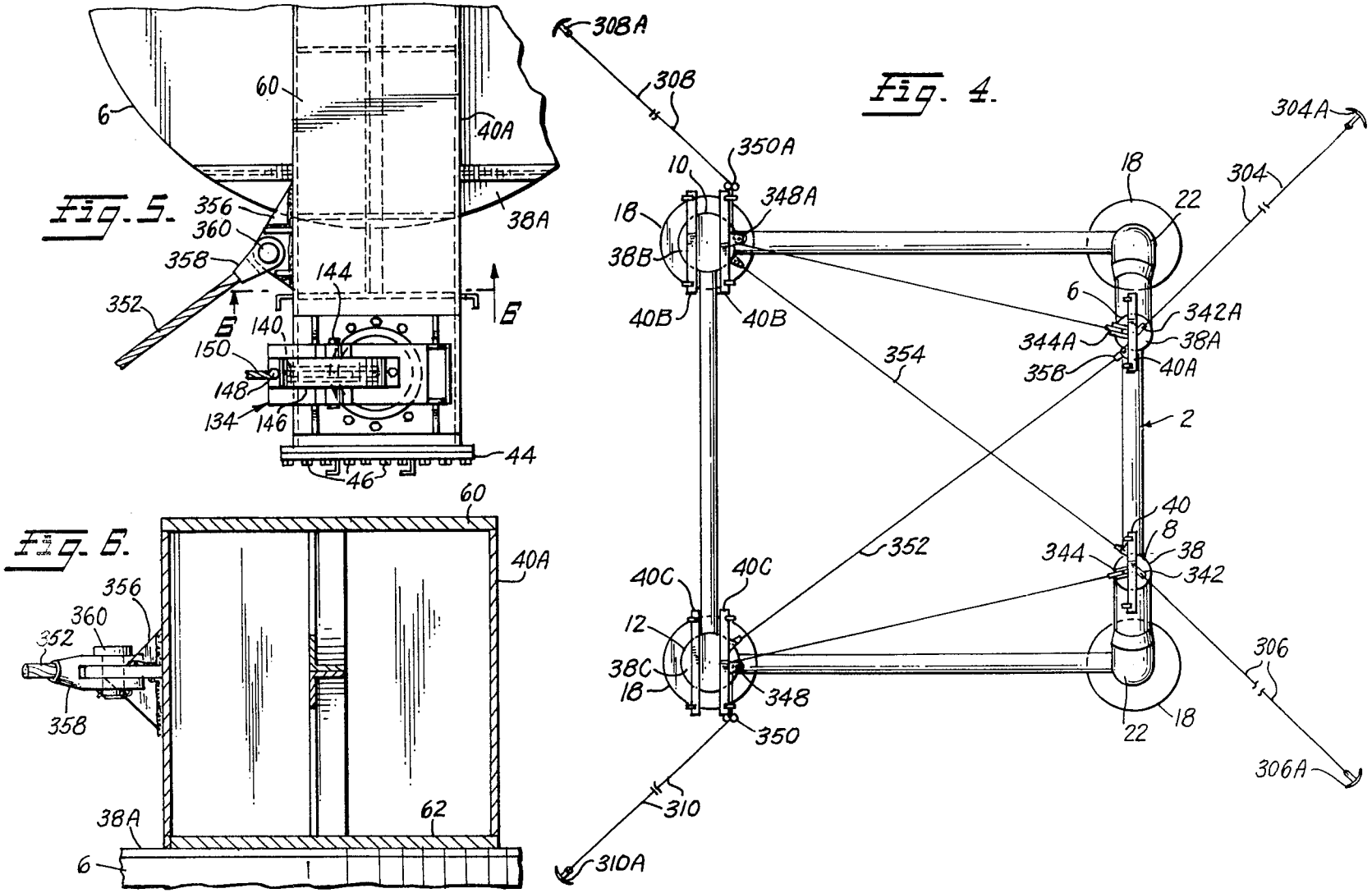
FIG. 4 is a schematic plan view of the support omitting the temporary struts to more clearly show the stabilizing guy lines and the tensioned diagonal cables bracing the upper ends of the caissons.
FIG. 5 is a fragmentary plan view illustrating the manner in which one end of one of the diagonal cables is connected with the superstructure at the top of one of the fore caissons.
FIG. 6 is a vertical cross-sectional view taken on the line 6—6 of FIG. 5.

As is shown in FIG. 4, the upper ends of the caissons 6, 8, 10 and 12 are braced against excessive bending forces by diagonally disposed tensioned cables 352 and 354. One of the cables 352 extends between the fore caisson 6 and the aft caisson 12 and the other cable 354 extends between the fore caisson 8 and the aft caisson 10. FIGS. 5 and 6 illustrate the manner in which the ends of the cables 352 and 354 are connected to their associated superstructures mounted upon the several caissons. Thus, as is shown in FIG. 5, a bracket 356 is welded to the superstructure 40A, for example, and the cable 352, for example, has a clevis 358 mounted on its end, which is connected to the bracket 356 by a pin 360. The cables 352 and 354, of course, are of predetermined length and are mounted so that they are in tension.

After the support 2 has been bottomed, the guy line 304 and attached anchor 304A are released and lowered onto a tug (not shown). The diagonally opposite guy line 310 and its attached anchor 310A are also released and lowered onto another tug (not shown). These guy lines are released by riggers working from the truss catwalks 31. The two tugs then move away at the same speed from the support in opposite directions and on an angle of about forty-five degrees relative to the support 2. After the tugs have moved the desired distance from the support 2, the anchors 304A and 310A are lowered to the sea bed S. Such movement of the tugs diagonally of the caissons 6 and 12 places minimum bending stress upon the caissons, which in any event is offset by the diagonal cable 352 that prevents movement of the upper ends of the caissons away from each other. The same procedure is followed with respect to setting the anchors 306A and 308A for the guy lines 306 and 308. Thus, the guy lines 304, 306, 308 and 310 extend in opposite divergent directions from the support 2 to impart maximum stability to the support 2 against wind, wave and tide action. It will be understood that the slack in the guy lines 304, 306, 308 and 310 can be adjusted by operating the drums of the winches 312 and 312A, as may be required. The hydraulic motors for driving the drums 320, 322, 320A and 322A are controlled from the cabin 32, as above stated, from which all operations can be observed.

The platform 4, which is to be mounted upon the support 2, resembles the hull of a barge and is provided at the shipyard with living quarters and all equipment necessary for oil well drilling and production operations. All such equipment has been omitted from the drawings, since it constitutes no part of the present invention. However, it may be mentioned that the platform 4 is quite large and may weigh 25,000 to 40,000 tons, depending upon the nature of its equipment.

The platform 4 is of generally rectangular configuration, as shown in FIGS. 3 and 9, and includes a heliport landing area 4A. The bow has two slots, or caisson wells, 362 and 364, which are open for their full height to receive the caissons 6 and 8. Additional caisson wells 366 and 368 are provided on opposite sides of the platform 4 near the stern for receiving the caissons 10 and 12, respectively. The caisson wells 362, 364, 366 and 368 are arranged in the same geometric pattern as the upper ends of the caissons 6, 8, 10 and 12, the caisson wells 362 and 364 necessarily being closer together than the caisson wells 366 and 368.

Figure 12:
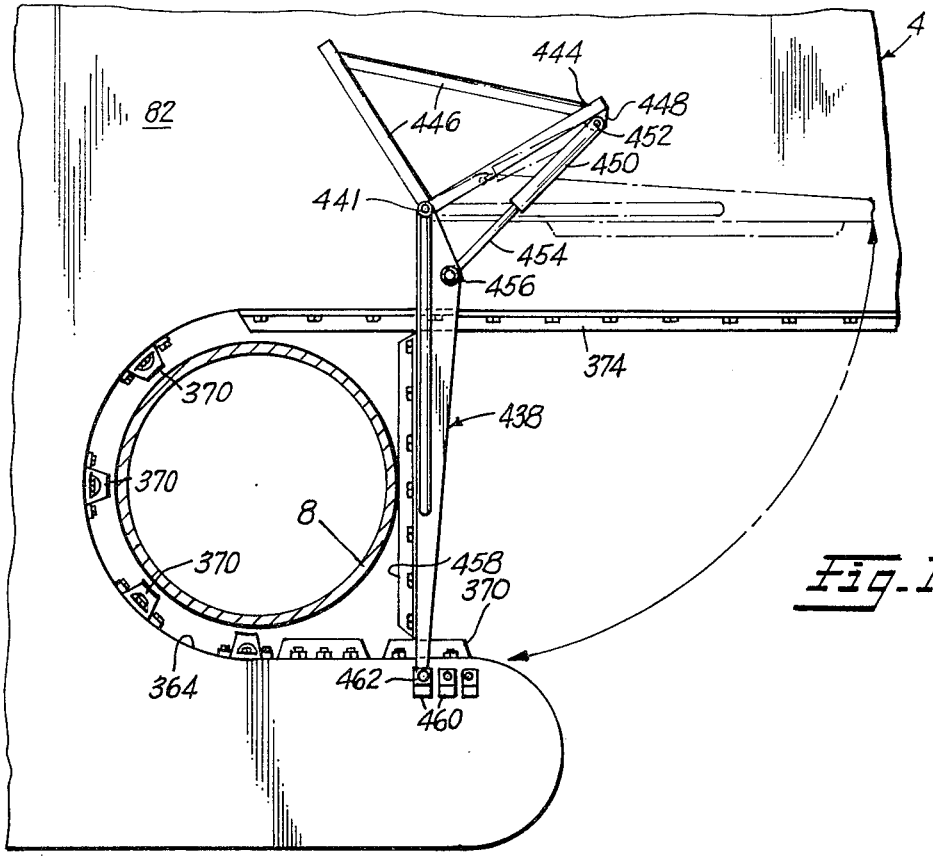
FIG. 12 is a fragmentary plan view of a fore caisson well illustrating a single locking gate arrangement for maintaining the platform in position relative to one of the fore caissons of the support.
Figure 13:
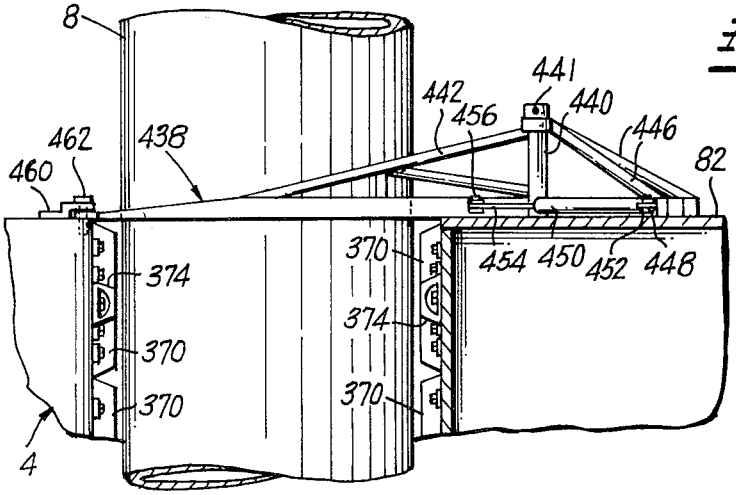
FIG. 13 is a fragmentary right side elevational view of the structure shown in FIG. 12.
Figure 17:
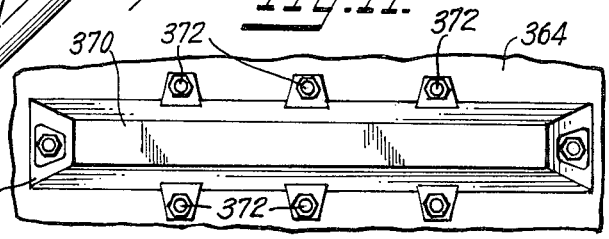
FIG. 17 is an elevational view of one of the horizontally mounted elastomeric fenders, as viewed on the line 17—17 of FIG. 15.
Figures 1A, 1B, 2D:
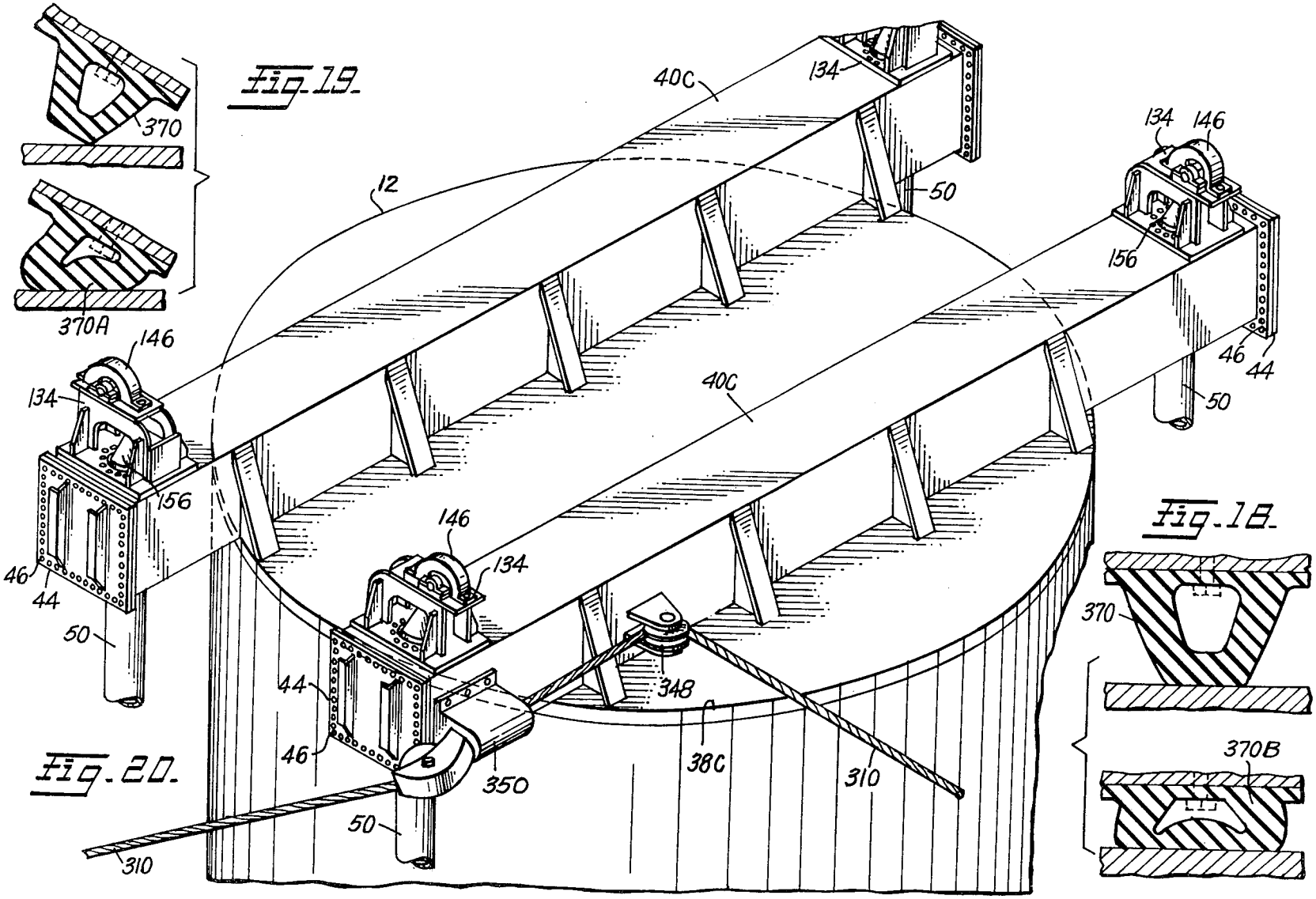

The caisson wells 362, 364, 366 and 368 are lined with hollow elastomeric fenders 370 (FIG. 9), secured in place by bolts 372 (FIG. 17). It will be noted from FIGS. 12 and 13 that some fenders 370 are mounted vertically and that others are mounted horizontally. Fender strips 374 extend along the sides of the platform from the caisson wells 362 and 364 to the caisson wells 366 and 368 and serve to protect the sides of the platform and the caissons from damage, principally as the platform 4 is being berthed relative to the support 2. Additional fender strips 376 are mounted in the caisson wells 362 and 364 to guide the platform 4 between the caissons 10 and 12 and to absorb initial impact berthing forces.

FIG. 19 illustrates in cross-section the manner in which the fenders 370 can deform to absorb angular impact. It will be noted from a comparison of the deformed fender 370A with the non-deformed fender 370, that the fender 370 is capable of considerable change in shape under impact forces. On the other hand, FIG. 18 illustrates the manner in which fender 370B can deform to absorb heavy impact shocks applied at right angles thereto. The provision of shock-absorbing fenders is important, particularly in rough water because they prevent damage to the caissons and/or platform during berthing of the platform and while it is subject to wave action, that is, before it has been raised above the wave level. The fenders also serve to yield and stabilize the floating platform relative to the support 2 during the early stages of the jacking operation, as will be readily understood.

Figure 16:
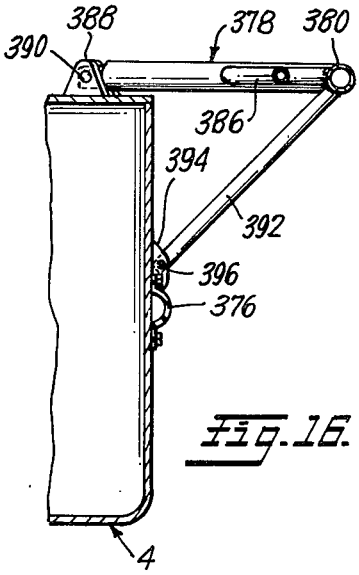
FIG. 16 is a fragmentary vertical sectional view taken on the leine 16—16 of FIG. 15.
Figure 15:
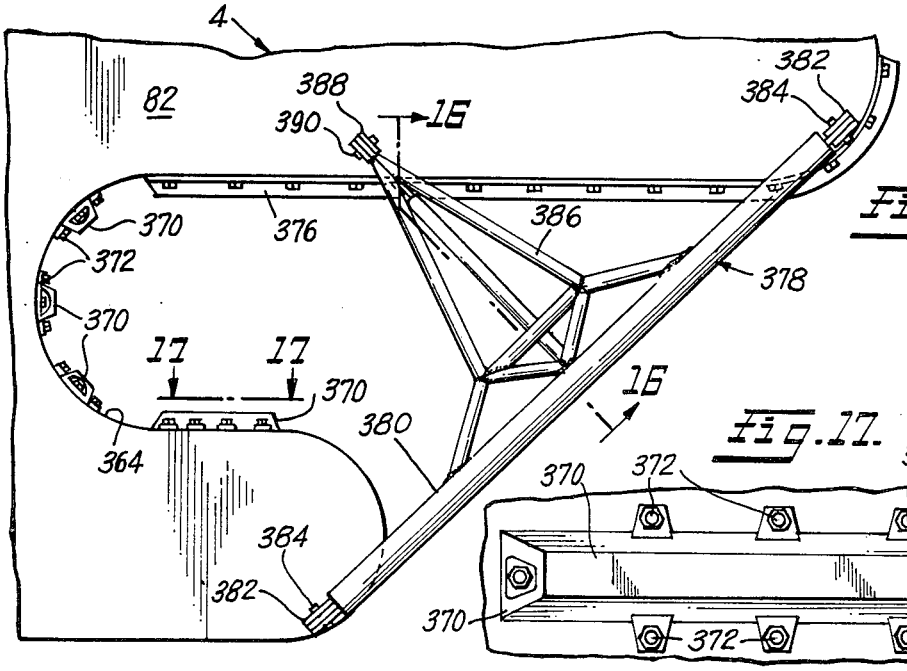
FIG. 15 is a fragmentary plan view illustrating the manner in which one of the temporary fenders is pin-connected across a fore caisson well.

As is shown in FIGS. 2 and 3, each of the forward caisson wells 362 and 364 has a temporary metal fender 378 that extends on about a 45-degree angle across the wells and guides the platform 4 into position between the caissons 10 and 12. In FIG. 2, the fender 378 is schematically shown engaging the caisson 12 for effecting lateral movement of the platform 4 toward the caisson 12, so that the bow of the platform 4 can readily enter the space between the caissons 10 and 12. In case of severe misalignment of the platform 4 with the support 2, such as illustrated, stand-by tugs 398 may be utilized to move the platform 4 sidewise. Each of the fenders 378 comprises a rigid tubular bar 380 that has end extensions that are mounted in deck brackets 382 by removable pins 384. The bar 380 is reinforced by horizontal bracing 386, the free end of which is secured in a deck bracket 388 by a removable pin 390. The bar 380 is further braced by an angular strut 392 connected to a hull bracket 394 by a removable pin 396, FIGS. 15 and 16.

Referring to FIG. 9, the platform 4 has two double-drum winches 400 and 402 mounted aft upon its deck 82, and two single drum winches 404 and 406 mounted foreward. Four anchor lines carried by the platform 4 are connected to certain of the foregoing drums, each anchor line comprising a section of cable, an anchor chain, and an anchor. The platform 4 is towed to a position in alignment with, but aft of, the support 2, and an aft anchor line 408 and its anchor 410 are transferred to a tug (not shown), which carries the anchor 410 to a distant point and lowers it to the sea bed. The anchor line 408 is connected to a drum 412 of the winch 400 and extends through a deck-mounted fairing 414. Another aft anchor line 408A, which extends through a similar fairing 414A and is connected to a drum 412A of the winch 402, and its anchor 410A are similarly deployed. A fore anchor line 416, which is connected to the winch 404, and its anchor 418 are extended by a tug (not shown) between the caissons 10–12 and 6–8 to a distant point forward of the support 2 at which point the anchor 418 is lowered to the sea bed. The fore anchor line 416 extends through a deck-mounted fairing 420. Another fore anchor line 416A, which is connected to the winch 406 and extends through a deck-mounted fairing 420A, and its anchor 418A are likewise extended between the caissons 10–12 and 6–8 and lowered.

Figure 10:
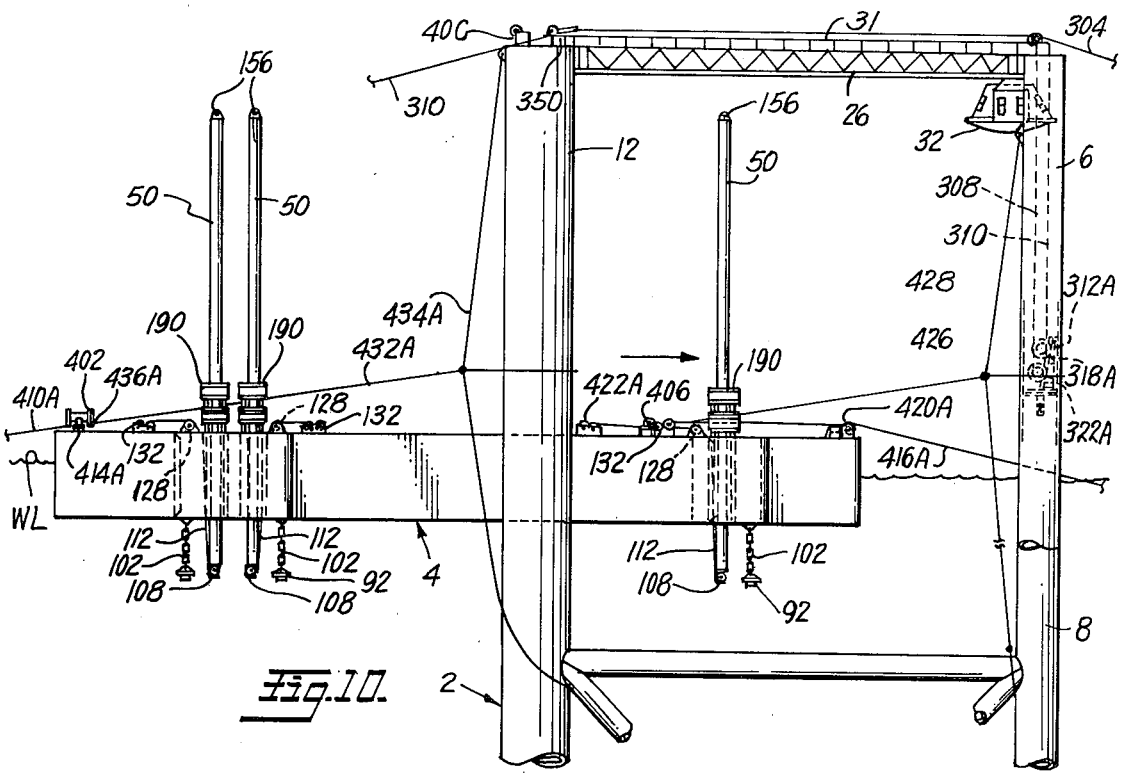
FIG. 10 is a schematic side elevational view of the structure shown in FIG. 9, but with the upper portions of the near caissons broken away and with jacking legs lowered, and the platform in a farther advanced position relative to the support.

It will be apparent from FIG. 9 that the platform 4 can be moved forwardly by taking up on the fore anchor lines 416 and 416A and correspondingly paying out the aft anchor lines 408 and 408A. However, before such movement is started, the jacking legs 50 on the platform 4 must be lowered so that their upper ends will clear the struts 24, 26, 28 and 30. This can be done by operating the deck winch 132 to release the cable 112 to lower the jacking leg 50 through the sleeve 80 while the cylinders 170 controlling the deck slips 162 are operated to release their grip on the jacking leg. The jack housings 188 and 192 are raised slightly to afford access to the heads 100 of the bolts 94 to loosen the same, which releases the covers 92 so that they dangle on their chains 102. The jacking leg 50 is then lowered through its sleeve 80 to the extend desired. The deck slips 162 are then actuated to grip and hold the jacking leg 50 in its lowered position. FIG. 10 schematically shows all of the jacking legs 50 lowered and the covers 92 dangling from their retrieval chains 102.

The platform 4 (FIG. 9) has two fore cable winches 422 and 422A mounted on its deck 82 arranged so that these winches can be operated to maneuver the platform 4 into final berthing position relative to the support 2. Drums 424 and 424A of the aft winches 400 and 402, respectively, are also utilized for this purpose. "Nylon" berthing cables may be lashed to the struts 24, 26, 28 and 30, individually released by riggers, and operably attached to the aforementioned winches and drums. Thus, a fore berthing cable 426 has one end thereof looped around the caisson 6 and is supported at a desired height by a pre-installed bridle 428, which is connected at its opposite ends to the support 2, as schematically shown in FIG. 10. The cable 426 is passed through a deck-mounted fairing 430 and then around the drum of the winch 422. Another fore cable 426A is similarly suppoted by a bridle 428A and passed through a fairing 430A to the winch 422A.

An aft berthing cable 432 is looped around the caisson 10 and supported by a bridle 434, which is connected at its opposite ends to the support 2. The cable 432 extends around a deck-mounted sheave 436 to the drum 424 of the aft winch 400. Another aft berthing cable 432A extends through a similar sheave 436A to the drum 424A of the aft winch 400A. The berthing winches 422, 422A and drums 424 and 424A are all controlled from the platform deck 82.

Figure 11:
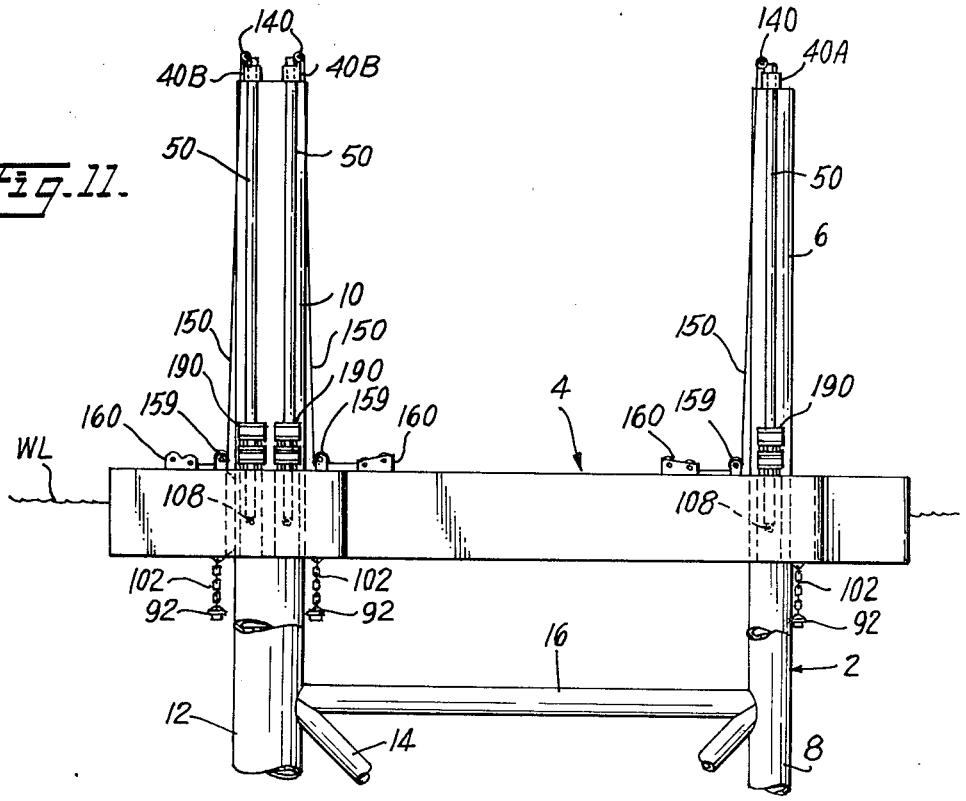
FIG. 11 is a similar view of the structure shown in FIG. 9, showing the platform berthed, and the jacking legs raised to their suspended position in the superstructures.

FIGS. 9 and 10 schematically show the platform 4 after it has been pulled by the "Nylon" berthing cables 426, 426A, 432 and 432A to a point beyond the aft caissons 10 and 12. The temporary metal fenders 376 are no longer needed and have been omitted. The anchor lines 416 and 416A may be used to assist in berthing the platform 4, as has been previously mentioned. Heavy ($2\frac{1}{2}$" diameter) "Nylon" berthing cables 426, 426A, 432 and 432A have been indicated because of their ability to withstand sudden loads without breaking. The platform 4 is fully berthed when the caisson wells 362, 364, 366 and 368 have been moved to a position in which their respective caissons 6, 8, 10 and 12 are disposed therein. Such condition is schematically indicated in FIG. 11 and at F in FIG. 1.

After the platform 4 has been berthed, locking gates on the platform, located at each of the caisson wells, are closed to maintain the platform docked relative to the support 2. Thus, in FIGS. 12 and 13, a single gate 438 is shown closed across the caisson well 364, which receives the caisson 8. The gate 438 comprises a tubular member 440, rotatable about a shaft 441, mounted on the platform deck 82. The gate 438 is welded to the lower end of the tube 440 and is braced by angular members 442 extending from the tube to the upper side of the gate. An arm 444 projects laterally from the tube 440 and is connected to angular bracing 446 extending from the upper end of the tube. The arm 444 carries a bracket 448 to which a hydraulic cylinder 450 is pivotally connected by a pin 452. A piston rod 454 extends from the cylinder 450 and is connected by a pin 456 to the gate 438. A resilient fender 458 is mounted upon the inner face of the gate 438 and engages the caisson 8 to protect it against damage. A plurality of keepers 460 is welded to the platform deck 82 and upon closing of the gate 438, a pin 462 is extended through one of the keepers, through an opening in the end of the gate 438 and into a hole in the deck to hold the gate closed. The provision of the several keepers 460 makes it possible to adjust the gate in one of several locking positions.

Figure 14:
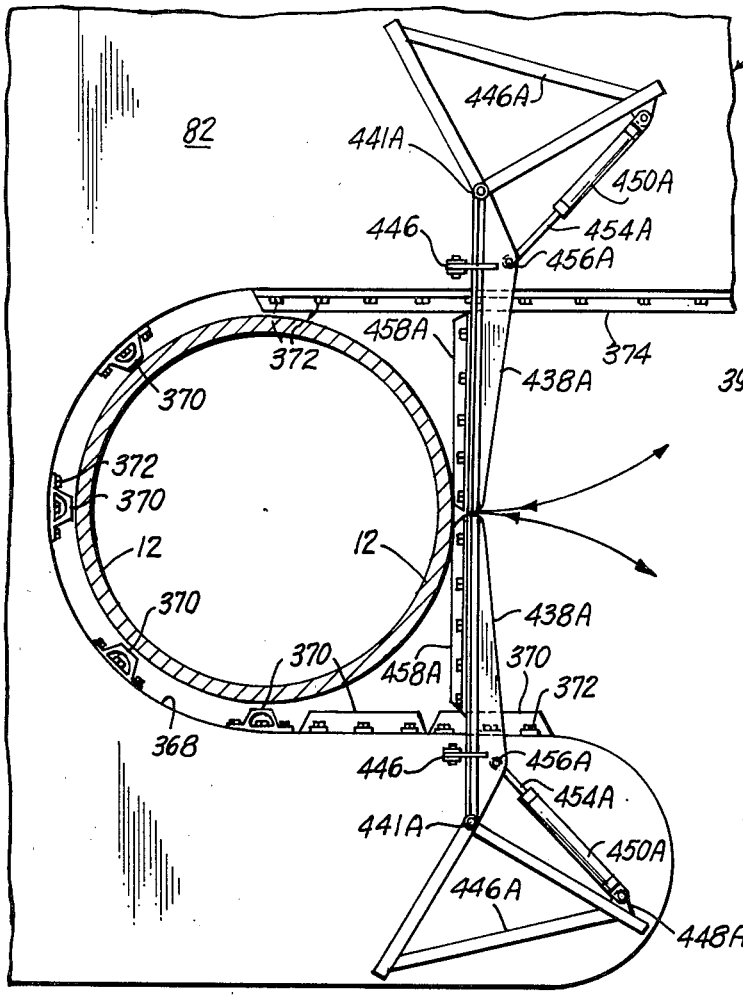
FIG. 14 is a fragmentary plan view of an aft caisson well and a double locking gate.

FIG. 14 illustrates a double gate 464 mounted on the platform 4 for locking the aft caissons 10 and 12 in the wells 366 and 368. The construction and mounting of each of the members of the double gate 464 is similar to that described in connection with the single gate 438. In the interest of brevity, the corresponding parts have been identified by the same reference numeral, except that the letter A has been added thereto. The individual gate members 438A can be locked closed by any suitable means, such as an adjustable latch 466 mounted upon the deck 82. It is here pointed out that the locking gates 438 and 438A have been omitted from FIGS. 3 and 9, for example, in the interest of simplicity of illustration.

After the locking gates 438 and 438A have been closed, all of the jacking legs 50 are raised until the upper ends thereof are gripped by the holding slips 48 in the several superstructures 40, 40A, 40B and 40C, employing either of the two methods described hereinbefore. FIG. 11 schematically illustrates the jacking legs 50 suspended from the superstructures 40A and 40C on the caissons 6 and 10, the upper end of the near caissons 8 and 12 being broken away to facilitate illustration. The berthing cables 416, 416A, 432 and 432A and their associated winches may now be removed to get them out of the way. The anchor lines 408, 408A, 416 and 416A are disconnected from the platform 4 and retrieved along with their anchor chains and anchors. The platform jacking operation can then be started.

Figures 37, 38, 39:
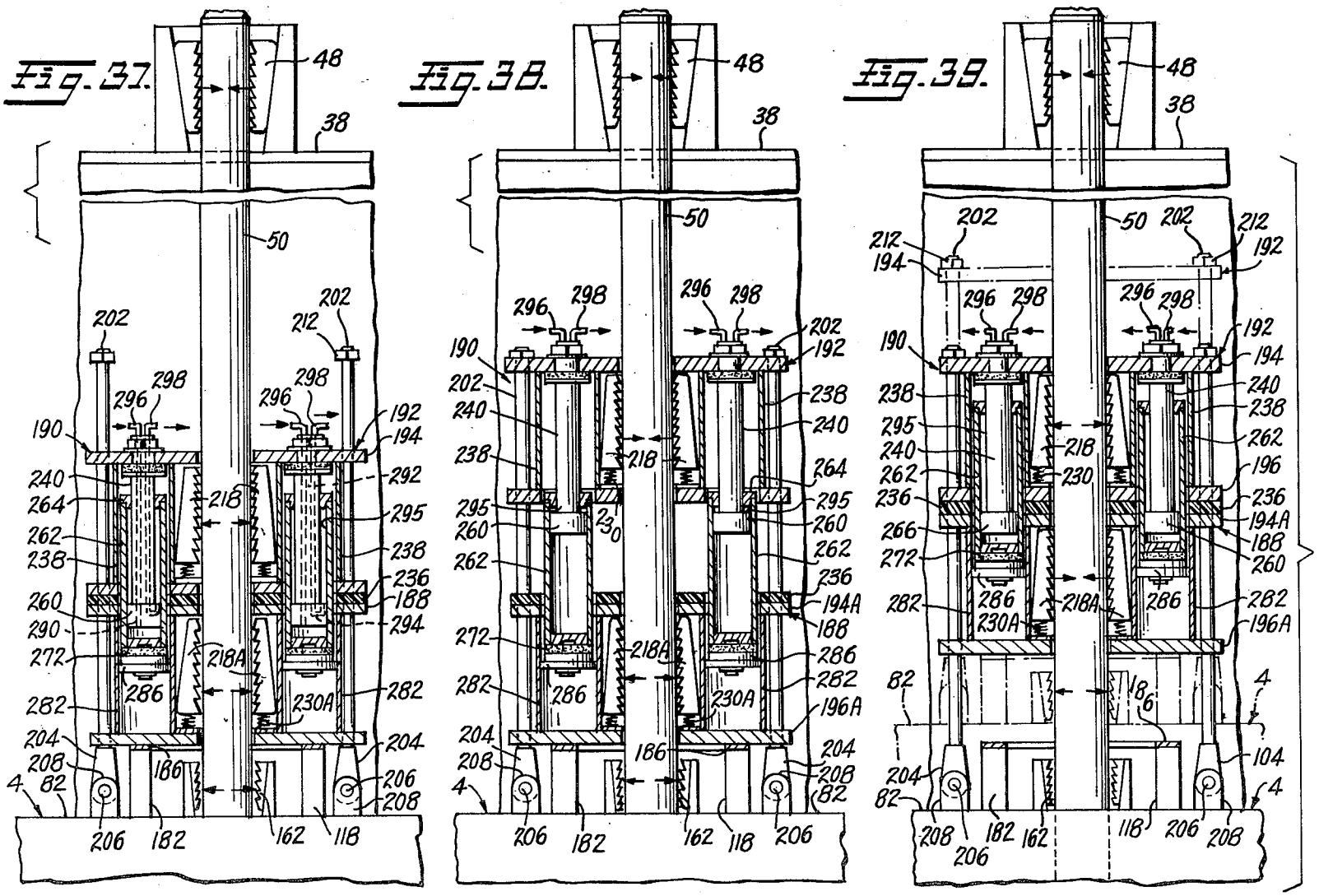
FIGS. 37, 38 and 39 are diagrammatic views illustrating the cycle of operation of the jacking units.

Referring to FIGS. 37, 38 and 39, which diagrammatically illustrate the jacking cycle, let it be understood that prior to jacking, the upper slip housing 192 is resting upon the lower slip housing 188, and that the deck slips 162, and the jack slips 218 and 218A are all released, as indicated by the arrows pointing in opposite directions, in FIG. 37. The jacking slips 218 and 218A remain in contact with the jacking legs 50; whereas the deck slips are held away from the jacking legs. The weight of the jacking legs 50 is carried by the holding slips 48. The platform 4 is thus free to move relative to the jacking legs 50 with wave action without danger of damaging the jacking legs. All slips are checked by moving them up and down in their respective holders to make certain that they are operating properly. The cylinders 262 now extend into the upper housing 192 in telescoping relation to the pistons 240. Such design enables the height of the jacking units 190 to be reduced to a minimum. The first step in the jacking cycle is to raise the upper slip housing 192 until it engages the nuts 212 on the lifting rods 202. Accordingly, operating fluid under pressure is simultaneously admitted through the conduits 296 into the passageways 290 in the pistons 240 and thence into the cylinders 262. At the same time, the passageways 292 and 294 are opened to exhaust through the conduits 298. The fluid under pressure acts upon the piston head 260 causing it to start moving upwardly into the upper housing 192. The reaction force at this time is transmitted through the lower slip housing 188 to the platform 4, as will be apparent from FIG. 37. As the upper housing 192 is being raised, the upper slips 218 will slide freely upwardly along the jacking legs 50 until the pistons 240 reach the end of their stroke, thereby engaging the upper plate 194 of the upper slip housing 192 with the nuts 212 on the lifting rods 202, as shown in FIG. 38.

Two important features of the invention to be noted are that the elastomeric pads 76, below the holders 74 for the continuously engaged holding slips 48, yield to permit the jacking legs 50 to pivot or move angularly, to the extent necessary, with rocking movement of the platform 4; and that the elastomeric elements 252, 256, 272 and 275 in the jacking units 190 afford pivoting action and provide flexibility, thus evenly distributing the weight and jacking loads while avoiding concentrated loads, misalignment, and buckling stresses between the pistons 240 and cylinders 262. Moreover, the tubular jacking legs 50 are themselves flexible.

Upon completion of the aforedescribed piston stroke, which may be three feet, the self-energizing action of the slips 218 will cause them to automatically grip the jacking leg 50, as indicated by the arrows pointing toward each other, and take on the weight of the platform 4. Operating fluid under pressure is admitted through the conduits 298 into the passageways 292 and 294 and thence into the space 295 in the cylinders 262 between the piston heads 260 and the cylinder heads 264. Spent fluid is simultaneously exhausted from the cylinders 262 through the passageways 290 and conduits 296. Such reverse flow of fluid can be readily effected by reversing the direction of flow from the pump units (not shown) in a manner well understood in the art. The fluid under pressure admitted into the space 295 will cause the cylinder 262 to move bodily upwardly into the upper housing 192, carrying the lower housing 188 with it, until the traveling cylinder 262 reaches the end of its stroke, as shown in FIG. 39. The pad 236 cushions the engagement of the lower housing 188 with the upper housing 192.

As soon as the pressure on the piston heads 260 has been relieved, the self-energizing action of the slips 218 in the upper slip holders 214 will automatically cause the slips 218 to tightly grip the jacking legs 50, and thereby take on the weight of the platform 4. The pistons 260 will remain stationary, and the cylinders 262 will be moved upwardly, as stated, raising the lower slip holders 214A a corresponding amount. The slips 218A slide freely upwardly along the jacking leg 50 during upward movement of the lower slip holder 188. The jacking mechanism 190 is now conditioned to perform its first hoisting stroke. Upon reversing flow of operating fluid to admit pressure fluid into the cylinders 262 below the piston head 260, as above described, the weight of the platform 4 is transferred from the upper slips 218 to the lower slips 218A. The pressure on the piston heads 260 will cause the pistons 240 to be bodily moved upwardly. Since the upper slip housing 192 is in contact with the nuts 212 on the lifting rods 202, the upward force will be transmitted through the lifting rods 202 to the platform 4, causing the platform to be elevated a corresponding increment relative to the caissons 6, 8, 10 and 12. The reaction force on the jacking legs 50 is transmitted to the holding slips 48 in their associated superstructures and thence to the upper end of the caissons.

During the jacking or hoisting stroke, the upper slips 218 will slide freely upwardly along their respective jacking legs 50. The upper end of the lifting rods 202 and the deck 82 of the platform 4 will be raised to the position shown in dot-and-dash lines in FIG. 39. At the end of the jacking stroke, the upper slip housing 192 and the lower slip housing 188 will have the relation to each other shown in FIG. 38. A new jacking cycle is started by raising the lower housing 188 into engagement with the upper housing 192, as previously described. The jacking cycle is repeated until the platform is raised to the desired height above the water.

It will be understood that the jacking process involves elevating the platform 4 in successive increments corresponding to the length of the jacking stroke. During a normal jacking operation, the upper jacking slips 218 will grip the jacking legs 50 and hold the platform 4 in the position to which it has been raised by a jacking stroke. On the other hand, all jacking strokes are performed by the lower jacking slips 218A, which effect raising of the platform 4 while the upper slip housings 192 are engaged with the nuts 212 on the lifting rods 202. In other words, all lifting of the platform 4 (other than by wave action) is effected by successive incremental movements effected by the lower slips 218A while gripping the jacking legs 50, and by the lifting rods 202 connected to the platform.

Should wave action raise the platform 4 during the jacking stroke, both sets of slips 218 and 218A will freely move upwardly along the jacking legs to accommodate the gratuitous "boost." As the wave action subsides, the slips 218A will instantly regain their grip on the jacking legs 50 and hold the platform 4 in such raised position. The upward movement of the cylinders 262 then continues and raises the platform 4 until the jacking stroke in progress has been completed. It is impossible for the platform to move downwardly because of the self-energizing action of the slips. The heavier the load, the tighter will be their grip on the jacking legs 50. Preferably, all of the jacking units 190 are operated simultaneously from controls (not shown) on the platform deck 82. Any leveling of the platform that may be required can be effected by operating one or more pairs of the jacking units 190 individually. The platform 4 is then fixed to the caissons 6, 8, 10 and 12 by plates (not shown) welded to the caissons and platform 4 at the caisson wells. The jacking units 190 can then be dismantled to get them out of the way preparatory to drilling.

While the platform jacking operation is in progress, and the platform 4 has been elevated above wave action, the entire weight of the platform 4 will be transferred to the footings 18 through the support 2. The sharp lower edges 305 of the footings 18 will be caused to further penetrate the sea bed S due to the added weight. The piles 300, particularly those associated with the caissons 10 and 12 are closed at their ends by plastic caps 309 (FIG. 1) and thus increase the buoyancy of the support. The caps 309 are removed before the support 2 is tilted upright.

The piles 300 are driven by a known type of underwater hammer (not shown), that is lowered onto the upper end of the piles. More than one pile 300 can be driven at the same time in each footing 18 to speed permanent anchoring of the support 2 to the sea bed S. Driving of the piles 300 can be expedited by jetting core material from the interior of the piles to facilitate penetration. After the piles 300 have been driven to their final depth, the underwater hammers are withdrawn and the piles 300 and footings 18 are filled with underwater concrete in accordance with methods well known in the art.

The present method of installing the piles 300 saves a great deal of steel by reducing the number of piles required to resist horizontal shear forces for any given installation. Fewer piles means less pile-driving time and lower costs. Furthermore, the driven piles 300 greatly increase the stability of the support 2.

After all of the piles 300 have been driven, the guy lines 304, 306, 308 and 310 are disconnected from the support 2 and retrieved together with their associated anchor chains and anchors. The cabin 32 is lowered to the platform deck 82 and mounted in a launching device 472 (FIGS. 7 and 8) for emergency use in evacuating personnel. The struts 24, 26, 28 and 30 are dismantled; the cover plates 30 and 30A, with their attached superstructures 40B and 40C are removed; and drilling rigs 474 are set up over the caissons 10 and 12 to start drilling.

It will be understood that various changes in design and arrangement of the components of the present support, platform and jacking apparatus may be made, including changes in the manner of positioning the jacking legs in the holding slips in the superstructures and in the superstructures themselves; and that the methods of stabilizing the support, berthing the platform, and manipulating the jacking mechanisms may be varied, all without departing from the principles of the invention or the scope of the annexed claims.

I claim:

1. The method of berthing a buoyant platform relative to a bottomed support having a pair of fore and aft upright caisson legs, comprising the steps of: mounting a pair of winches fore and a pair of winches aft on the platform; connecting one end of an anchor line to each of said winches; positioning the platform off the aft end of the support in general alignment therewith; running the anchor lines from the aft winches rearwardly from the platform, connecting sea anchors thereto, and lowering the sea anchors to the sea bed at points distant from the platform; running the anchor lines from the fore winches forwardly between the caissons, connecting sea anchors thereto, and lowering the sea anchors to the sea bed at points distant from the fore caissons; operating the winches to take up the anchor lines so as to align the platform for entry between the caissons; and taking up the fore anchor lines to move the platform forwardly relative to the support while correspondingly paying out the aft anchor lines.

2. The method described in claim 1, including the further steps of: mounting additional winch means on the platform; extending a cable from respective of said winch means to each caisson; and operating said winch means to pull the platform into final berthing position relative to the support.

3. The method of stabilizing a prefabricated off-shore drilling platform support and berthing a bouyant platform relative thereto, said support having a pair of fore and a pair of aft caisson legs and which support has been bottomed in an upright position, comprising the steps of: mounting reversible winch means on at least two of the caissons; connecting one end of a pair of fore and one end of a pair of aft guy lines to respective of said winch means; connecting the other end of each of said guy lines to a sea anchor; lowering the sea anchors to the sea bed at divergent distant points fore and aft of said support; operating said winch means to control the slack in said guy lines; mounting a pair of winches fore and a pair of winches aft on the platform; connecting one end of an anchor line to each of said winches; positioning the platform off the aft end of the support in general alignment therewith; running the anchor lines from the aft winches rearwardly from the platform, connecting sea anchors thereto, and lowering the sea anchors to the sea bed at points distant from the platform; running the anchor lines from the fore winches forwardly between the caissons, connecting sea anchors thereto, and lowering the sea anchors to the sea bed at points distant from the fore caissons; operating the winches to take up the anchor lines so as to align the platform for entry between the caissons; and taking up the fore anchor lines to move the platform forwardly relative to the support while correspondingly paying out the aft anchor lines.

4. The method described in claim 3, including the further steps of: mounting additional winches fore and aft on the platform; connecting each of the fore caissons by a cable to respective of said additional fore winches; connecting each of the aft caissons by a cable to respective of said additional aft winches; and operating said additional winches to adjust the platform into final berthing position relative to the support.

5. The method described in claim 4, wherein the platform has jacking means for elevating the platform on the support, including the further step of: operating the jacking means to elevate the platform on the support.

6. The method of berthing a platform, comprising a body having a caisson well at each side thereof near its fore and aft ends, respectively, the fore caisson wells being closer together than the aft caisson wells, relative to a bottomed support having a pair of fore and a pair of aft upright caissons, the fore caissons being parallel and closer together at their upper portion than the aft caissons and being arranged in the same geometric pattern as the caisson wells, comprising the steps of: mounting a pair of winches fore and a pair of winches aft on the platform; connecting one end of an anchor line to each of said winches; positioning the platform off the aft end of the support with its caisson wells in general alignment with the support caissons; running the anchor lines from the aft winches rearwardly from the platform, connecting sea anchors thereto, and lowering the sea anchors to the sea bed at points distant from the platform; running the anchor lines from the fore winches forwardly between the fore caissons, connecting sea anchors thereto, and lowering the sea anchors to the sea bed at points distant from the fore caissons; operating the winches to take up the anchor lines so as to align the platform for entry between the support caissons; and taking up the fore anchor lines to move the platform forwardly relative to the support while correspondingly paying out the aft anchor lines until the fore and aft caissons are received in the fore and aft caisson wells.

* * * * *